United States Patent [19]

Houserman

[11] Patent Number: 4,809,838

[45] Date of Patent: Mar. 7, 1989

[54] COIN DETECTION MEANS INCLUDING A CURRENT RAMP GENERATOR

[75] Inventor: Raymond L. Houserman, St. Louis County, Mo.

[73] Assignee: Coin Acceptors, Inc., St. Louis, Mo.

[21] Appl. No.: 62,188

[22] Filed: Jun. 15, 1987

[51] Int. Cl.[4] ..... G07D 5/08

[52] U.S. Cl. ..... 194/317; 324/329

[58] Field of Search ..... 194/317, 318, 319; 324/329

[56] References Cited

U.S. PATENT DOCUMENTS

| | | | |
|---|---|---|---|
| 3,653,481 | 4/1972 | Boxall et al. | 194/322 |
| 3,739,895 | 6/1973 | Fougere et al. | 194/325 |
| 3,797,307 | 3/1974 | Johnston | 194/325 X |
| 3,797,628 | 3/1974 | Fougere et al. | 194/324 |
| 4,110,679 | 8/1978 | Payne | 324/329 |
| 4,124,111 | 11/1978 | Hayashi | 194/334 |
| 4,509,633 | 4/1985 | Chow | 194/334 |
| 4,538,719 | 9/1985 | Gray et al. | 194/317 |
| 4,646,904 | 3/1987 | Hoormann | 194/334 |
| 4,664,244 | 5/1987 | Wright | 194/317 |
| 4,705,154 | 11/1987 | Masho et al. | 194/334 X |

*Primary Examiner*—F. J. Bartuska

*Attorney, Agent, or Firm*—Haverstock, Garrett & Roberts

[57] ABSTRACT

A coin detection system and method of operation thereof, comprising a sensing circuit portion including a sensor coil, which need be only a single sensor coil, positioned adjacent to the coin path and connected in circuit with a current ramp generator, preferably operable under control of a system control circuit portion, and a detector circuit portion connected to the sensing circuit portion to monitor and detect circuit performance characteristics and changes thereof that are effected by the presence of a coin within the field of the sensor coil at the time a current ramp is applied to the sensor coil by the ramp generator, from which circuit performance characteristics a coin characteristic value, preferably a time constant characteristic, representative of the particular coin present within the field of the sensor coil can be derived and thereafter utilized for coin detection, denomination discrimination, and coin sizing purposes.

30 Claims, 10 Drawing Sheets

COIN DETECTION MEANS INCLUDING A CURRENT RAMP GENERATOR

BACKGROUND OF THE INVENTION

The present invention relates to a coin detection means and method, and, more particularly, to a coin detection means that employs a derived time constant characteristic tau ($\tau$) representative of the coin undergoing examination, for coin detection and discrimination purposes, and to the method of use thereof.

It will be appreciated that, throughout this application, the term "coin" may be employed to mean any coin (whether valid or counterfeit), token, slug, washer, or other item which might be used by an individual in an attempt to operate a coin-operated device or system. An "acceptable coin" is considered to be an authentic coin, token, or the like of the monetary system or systems in which or with which the coin-operated device or system is intended to operate and of a denomination which the device or system is intended selectively to receive and to treat as an item of value.

Over the years a number of coin detection, validation, and verification means and techniques have been developed and utilized. Among the more effective of such means and techniques have been coin validation systems that have utilized a pair of coils positioned in a face-to-face arrangement to detect certain performance characteristics of circuits of which the coils form a part and the changes that occur in such performance characteristics when coins of different values pass between the coils of the coil pair. The use in such systems of a pair of coils, as opposed to a single coil, was found to be necessary and/or desirable in almost all instances in order to minimize system dependency upon coin-to-coil distances. By placing a pair of coils in a face-to-face arrangement, and by requiring the coin to be examined to pass therebetween, such dependency and the overall sensitivity of such validation systems to variations in distance between the coin and a given coil could be minimized. However, the use of a pair of coils in such systems, as opposed to a single coil, has resulted in increased system costs, both in terms of additional components and the labor required to install and service such additional components.

Additionally, and for the most part, such systems have required the tuning of individual constructions thereof in order to achieve a relative uniformity of operational result from individual construction to individual construction since the effect upon the circuit performance characteristics of a coin passing between the pairs of coils of different individual constructions of a given system type has been found to vary from construction to construction due to variations in construction component values and parameters, many of which variations, though perhaps minor, are nonetheless unpredictable, at least to some degree. Such variations may typically include deviations from individual construction to individual construction in coil inductance, coil resistance, circuit capacitance, and power supplies, among other things. By employing some type of tuning or programming for such individual constructions during system manufacture, which tuning or programming adds further in component and labor costs, a relative uniformity in end result from individual construction to individual construction can be achieved. However, even with such tuning and/or programming during the manufacture of the individual constructions, there remains a possibility that component values may change over time or that the system may drift out of tune, resulting in subsequent performance problems at later times. Still further, with many validation systems of the type under discussion, it has been found necessary or desirable to employ multiple pairs of coils because of an inability to obtain sufficient information for coin validation purposes from a single pair of coils, which additional components result in still further costs in components and labor.

The coin detection means of the present invention is designed to eliminate or minimize the need for many of such additional components, and the labor associated therewith, yet to permit coin detection and validation to be accomplished by the use of only a single sensor coil instead of one or more pairs of sensor coils. As so designed and constructed, the coin detection means of the present invention operates to detect a coin, when it is within the field of the sensor coil, essentially independently of coin-to-coil distance, and with little or no need for tuning and/or individualized construction programming during an individual construction's manufacture, to permit a time constant characteristic of a detected coin to be derived through the utilization of a single sensor coil.

SUMMARY OF THE INVENTION

The coin detection means of the present invention comprises a circuit means including a sensor coil, which need be only a single sensor coil, positioned adjacent to the coin path and connected in circuit with a current ramp generator, preferably operable under control of a system control means, and detector means connected to said circuit means to monitor and detect circuit performance characteristics and changes thereof that are effected by the presence of a coin within the field of the sensor coil at the time a current ramp is applied to the sensor coil by the ramp generator, from which circuit performance characteristics a time constant characteristic representative of the particular coin present within the field of the sensor coil can be derived and utilized to distinguish between different coin denominations. The derived time constant is essentially independent of both the coin-to-coil distance and various circuit parameters, such as the inductance and resistance of the sensor coil and the slope of the current ramp, as a consequence of which (a) such coin detection means does not require the use of a pair of coils positioned in a face-to-face arrangement, (b) little or no tuning of individual constructions is required, and (c) problems associated with component value changes or the system drifting out of tune are greatly minimized.

In light of what has been discussed hereinabove, it will be appreciated that a principal object of the present invention is to provide an improved means and method for detecting and validating coins.

A further object of the invention is to teach a coin detection means and method that requires only a single sensor coil.

A still further object of the invention is to provide a coin detection means wherein changes in circuit performance characteristics are produced during coin detection, from which changes a characteristic representative of the coin detected, yet essentially independent of circuit component parameters, can be derived.

Another object of the invention is to teach a method of detecting and validating coins by deriving, from detected changes effected in the performance characteristics of a circuit by the presence of a coin within the field thereof, a time constant characteristic representative of such detected coin.

Still another object is to teach the construction and use of a coin detection and validation means that includes a single sensor coil wherein a characteristic essentially independent of coin-to-coil distance, yet representative of a particular coin denomination, is derived when a coin is present within the field of the sensor coil.

A still further object of the invention is to provide a coin detection means the separate and individual constructions of which require little or no tuning to ensure accurate operation thereof.

Yet another object of the invention is to provide a coin detection means wherein problems associated with component value drift are largely eliminated or minimized.

These and other objects and advantages of the present invention will become apparent after considering the following detailed specification in conjunction with the accompanying drawings, wherein:

DETAILED DESCRIPTION OF PREFERRED EMBODIMENTS

Figure 1:
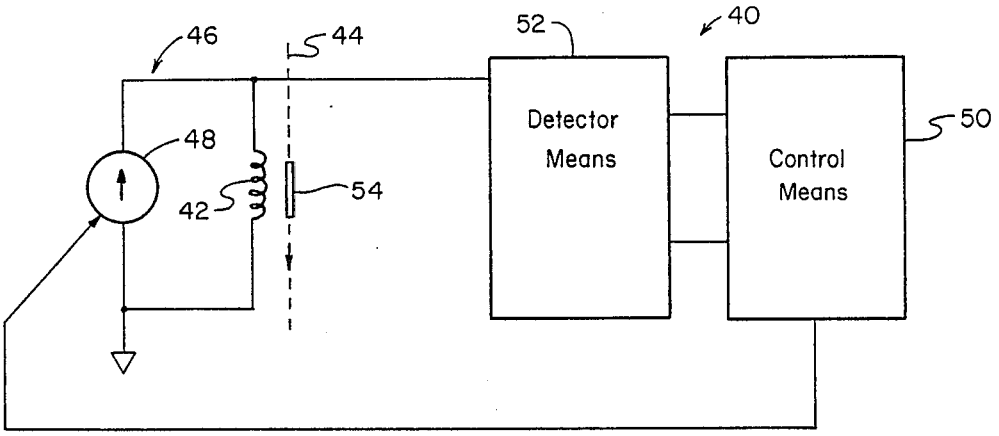
FIG. 1 is a generalized block diagram depiction of the coin detection means of the present invention.

Referring now the drawings, wherein like numbers refer to like items, the number 40 in FIG. 1 refers to a coin detection means that includes a single sensor coil 42 positioned adjacent to a coin path 44 and connected in a circuit 46 with a current ramp generator 48 operable under control of a system control means 50, and detector means 52 connected to said circuit 46 to monitor and detect circuit performance characteristics and changes thereof that are effected by the presence of a coin 54 in the field of the sensor coil 42, from which changes in circuit performance characteristics a time constant characteristic representative of the particular coin present in the field of the sensor coil can be derived and utilized to distinguish between different coin denominations.

It will be appreciated by those knowledgeable in the art that a coin may be modeled as an inductance $L_c$ and a resistance $R_c$, the values of which are dependent upon the characteristics of the coin, including its size and thickness, electrical conductivity, and magnetic permeability. Such values may be combined into a single ratiometric parameter $L_c/R_c$. Since the ratio L/R is commonly designated as tau ($\tau$), the ratiometric parameter $L_c/R_c$ for any given coin will hereafter, for ease of reference, be referred to as $tau_c$ ($\tau_c$). The present invention permits the $tau_c$ for the coin 54 in the presence of the sensor coil 42 to be derived and utilized to distinguish such coin from coins of different denominations.

Figure 2:
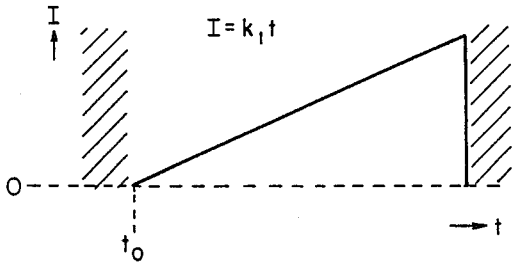
FIG. 2 depicts an idealized current ramp waveform of the type that would be produced by the current ramp generator depicted in FIG. 1.

It will be understood that the voltage $V_s$ across the sensor coil 42 can be easily monitored and that, in the absence of a coin, the application of a current ramp $I=k_1t$ (see FIG. 2), where $k_1$ is a constant, by current ramp generator 48 to sensor coil 42 will result in a voltage $V_{s(nc)}=k_1L_s+k_1R_st$ (see FIG. 3) across such coil, where $V_{s(nc)}$ is the voltage $V_s$ across sensor coil 42 in the absence of a coin, $L_s$ is the effective inductance of the sensor coil 42, and $R_s$ is the effective resistance of such coil. However, if a coin 54 is present within the field of the sensor coil 42 at the time the current ramp $I=k_1t$ is applied, the resulting voltage $V_s$ across such coil is modified, and has been found to satisfy the equation $$V_{s(cp)}=k_1L_s+k_1R_st-k_2e^{(-t/tauc)}+k_o(c),$$

where $V_{s(cp)}$ is the voltage across sensor coil 42 when a coin is present in the field thereof, $k_2$ is a constant determined by various factors, including the coin-to-coil distance, $tau_c$ is a parameter of the coin independent of $L_s$, $R_s$, $k_1$, and $k_2$, and $K_o(c)$ is an offset value attributable to the change in the total reluctance of the flux path caused by the presence of the particular coin c within the field of the sensor coil. For coins of low magnetic permeability $K_o(c)$ has been found to be essentially zero, while for coins of high magnetic permeability, i.e., ferromagnetic coins, $K_o(c)$ is a coin dependent value which must be taken into consideration, as will become better understood from that which follows.

Figure 3:
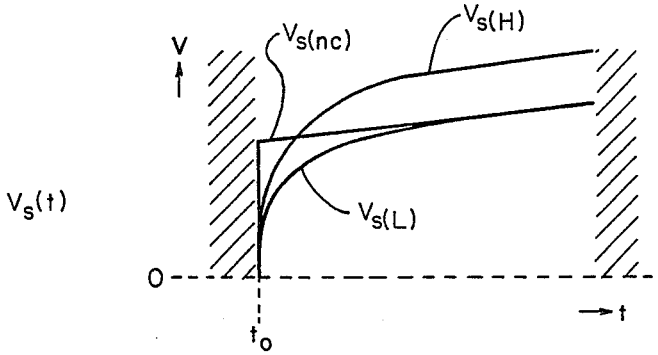
FIG. 3 depicts idealized waveforms of the resulting voltage across the sensor coil depicted in FIG. 1 upon the application of a current ramp thereto, both when no coin is present in the field of the sensor coil and when given coins of low and high magnetic, permeability are present in the field.
Figure 4:
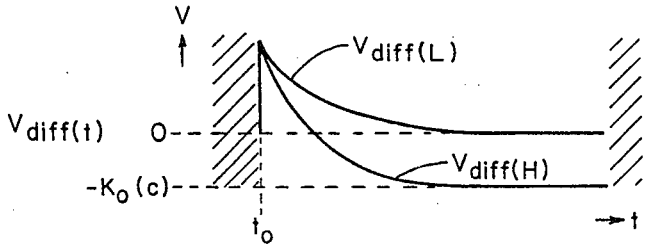
FIG. 4 depicts idealized waveforms representative of the differences between the "no coin" waveform and the "coin present" waveforms of FIG. 3.

FIG. 3 depicts typical $V_s$ waveforms across the sensor coil 42 effected by the application of current ramps to such sensor coil in situations when no coin is present in the field of the coil (waveform $V_{s(nc)}$), when a coin of low magnetic permeability is present in the field of the coil (waveform $V_{s(L)}$), and when a coin of high magnetic permeability is present in the field of the coil (waveform $V_{s(H)}$. The detectible difference between $V_{s(nc)}$ and $V_{s(cp)}$ may be expressed as $$\begin{aligned} V_{diff}(t) &= V_{s(nc)} - V_{s(cp)} \\ &= k_1L_s + k_1R_st - (k_1L_s + k_1R_st - k_2e^{(-t/tauc)} + K_o(c)) \\ &= k_2e^{(-t/tauc)} - K_o(c), \end{aligned}$$

where $V_{diff}(t)$ is the voltage difference at time t. FIG. 4 depicts typical $V_{diff}(t)$ waveforms for a coin of low magnetic permeability (waveform $V_{diff(L)}$) and for a coin of high magnetic permeability (waveform $V_{diff(H)}$).

As has been previously discussed, for coins of low magnetic permeability $K_o(c)$ may be considered to be essentially zero. For such coins, then, the voltage differential between $V_{s(nc)}$ and $V_{s(L)}$ may be expressed as $V_{diff}(t)=k_2e^{(-t/tauc)}$. As so expressed, such equation contains four unknowns, viz., $V_{diff}(t)$, $k_2$, t, and $tau_c$. However, if the value of $V_{diff}(t)$ can be measured at at least two different specific times relative to time $t_o=0$, where $t_o$ represents the time of application of a current ramp to the sensor coil 42, one can obtain two equations in two unknowns, viz., $V_A=k_2e^{(-TA/tauc)}$ and $V_B=k_2e^{(-TB/tauc)}$, where $V_A$ is the measured value of $V_{diff}(t)$ at time $T_A$ and $V_B$ is the measured value of $V_{diff}(t)$ at time $T_B$. Since it is well known that two equations in two unknowns can be readily solved, it will be appreciated that $tau_c$ can thus be derived for coins of low magnetic permeability from two or more time-voltage measurement pairs, the values of which are determined by the performance characteristics of circuit 46 when such coin is present within the field of sensor coil 42. By way of illustration, if two time-voltage measurement pairs $(T_A,V_a)$ and $(T_B,V_B)$ are obtained, in accordance with which $V_A=k_2e^{(-TA/tauc)}$and $V_B=k_2e^{(-TB/tauc)}$, and if $k_3$ is defined to be the ratio of $V_A$ to $V_B$, i.e., if $k_3=V_A/V_B$, then $V_A=k_3V_B$, as a consequence of which $V_A$ may be expressed as $V_A=k_2e^{(-TA/tauc)}=k_3 \cdot k_2e^{(-TB/tauc)}$. In accordance therewith, $e^{(-TA/tauc)}=k_3e^{(-TB/tauc)}$and $k_3=e^{[(TB-TA)/tauc)]}$. Therefore, $\ln(k_3)=[(T_B-T_A)/tau_c]$, and, solving for $tau_c$, $tau_c=[T_B-T_A)/\ln(k_3)]=[(T_B-T_A)/\ln(V_A/V_B)]$.

In light of what has been discussed hereinabove, it will be further appreciated that, in many instances, only coins of low magnetic permeability may be of interest, as a consequence of which a means for detecting or separating coins of high magnetic permeability may sometimes be utilized prior to the coin detection means of the present invention to eliminate coins of high magnetic permeability from consideration by such coin detection means. Since U.S. coins are presently coins of low magnetic permeability, any means capable of detecting or separating coins of high magnetic permeability before the examination thereof by the present invention could be advantageously employed, and, in such cases, since only coins of low magnetic permeability would then be undergoing examination by the coin detection means of the present invention, the detection means 52 and the control means 50 could be so designed and/or programmed that $tau_c$ for any examined coin could be derived based upon two time-voltage measurement pairs of $V_{diff}(t)$.

If, however, coins of high magnetic permeability are of interest and/or no means for detecting or separating coins of high magnetic permeability is employed prior to the coin detection means of the present invention, two time-voltage measurement pairs may provide insufficient information to permit $tau_c$ to be uniquely derived for any detected coin. It should be recalled that the equation representing the voltage difference is actually $V_{diff}(t)=k_2e^{(-t/tauc)}-K_o(c)$ and that $K_o(c)$, which is essentially zero for coins of low magnetic permeability, is a non-zero coin dependent constant for coins of high magnetic permeability. Consequently, $K_o(c)$ must be taken into account whenever the coin undergoing examination could possibly be a coin of high magnetic permeability. If $K_o(c)$ is unknown for a given deposited coin, as would generally be the case if the coin is subjected to only a single coin detection operation, the noted equation would then contain five unknowns, viz., $V_{diff}(t)$, $k_2$, t, $tau_c$, and $K_o(c)$, and two time-voltage measurement pairs would therefore result in two equations in three unknowns, from which $tau_c$ could not be readily determined. However, if three time-voltage measurement pairs could be obtained, $tau_c$ could in such case be uniquely derived, in similar fashion to that previously discussed, from three resulting equations in three unknowns, viz., $V_A=k_2e^{(-TA/tauc)}-K_o(c)$, $V_B=k_2e^{(-TB/tauc)}-K_o(c)$, and $V_D=k_2e^{(-TD/tauc)}-K_o(c)$, where $V_A$ is the measured value of $V_{diff}(t)$ at time $T_A$, $V_B$ is the measured value of $V_{diff}(t)$ at time $T_B$, and $V_D$ is the measured value of $V_{diff}(t)$ at time $T_D$.

In view of the foregoing discussions, it should now be readily apparent to those skilled in the art that the $tau_c$ of any coin, whether of low or high magnetic permeability, can be derived based upon three or more time-voltage measurement pairs of $V_{diff}(t)$. Those skilled in the are will further recognize, however, that, while $tau_c$ can be uniquely derived for any coin based upon three time-voltage measurement pairs obtained during a coin examination operation, if multiple coin examination operations are conducted with respect to a given coin, as is often the case, it may be possible during the course of such multiple coin examination operations of the given coin c to determine $K_o(c)$, or a reasonable approximation thereof, as a consequence of which it may then be possible during a subsequent coin examination operation with respect to such coin c, since $K_o(c)$ is then known for such coin, to uniquely derive $tau_c$ for such coin, even if such coin is a coin of high magnetic permeability, based upon only two subsequently obtained time-voltage measurement pairs. The manner in which this may be accomplished will become clearer from that which follows.

From all of the foregoing, it should now be readily understood that the presence of any coin within the field of the sensor coil 42, whether such coin is of low or high magnetic permeability, will effect a circuit reaction upon application of a current ramp to such coil such that the voltage difference $V_{diff}(t)$ may be expressed in terms of a decaying exponential, the time constant of which is the ratio $tau_c$ of the coin's inductance $L_c$ to its resistance $R_c$, which ratio value can be utilized to distinguish between different denominations of coins. In the embodiment depicted in FIG. 1, detector means 52 and control means 50 operate in conjunction with one another to derive, from the circuit performance characteristics of circuit 46, the $tau_c$ value for any given coin within the field of the coil 42 at the time a current ramp is applied to such coil, and to then determine whether such derived $tau_c$ value is a value representative of a valid coin. The $tau_c$ value may be derived from the circuit performance characteristics in a variety of ways, including, by way of example only and not by way of limitation, (1) by detecting the instantaneous voltage value of $V_{diff}(t)$ at a plurality of known times and by then utilizing such time-voltage pairs to calculate the time constant $tau_c$ of the decaying exponential, (2) by noting for a plurality of different, selected voltage values the times at which $V_{diff}(t)$ equals such voltage values and by then utilizing such time-voltage pairs to calculate t-he time constant $tau_c$ of the decaying exponential, (3) by detecting the instantaneous voltage of $V_{diff}(t)$ at a selected time, by thereafter noting the later times at which $V_{diff}(t)$ becomes equal to known lower voltages, and by then utilizing such time-voltage pairs to calculate the time constant $tau_c$ of the decaying exponential, or (4) by detecting a first instantaneous voltage of $V_{diff}(t)$ at a given time, by thereafter noting the later times at which $V_{diff}(t)$ becomes equal to other voltages that are some fractional values of the first voltage, and by then utilizing such time-voltage pairs to calculate the time constant $tau_c$ of the decaying exponential. With all of such enumerated methods a plurality of time-voltage pairs can be readily obtained for use in deriving $tau_c$.

Figure 5:
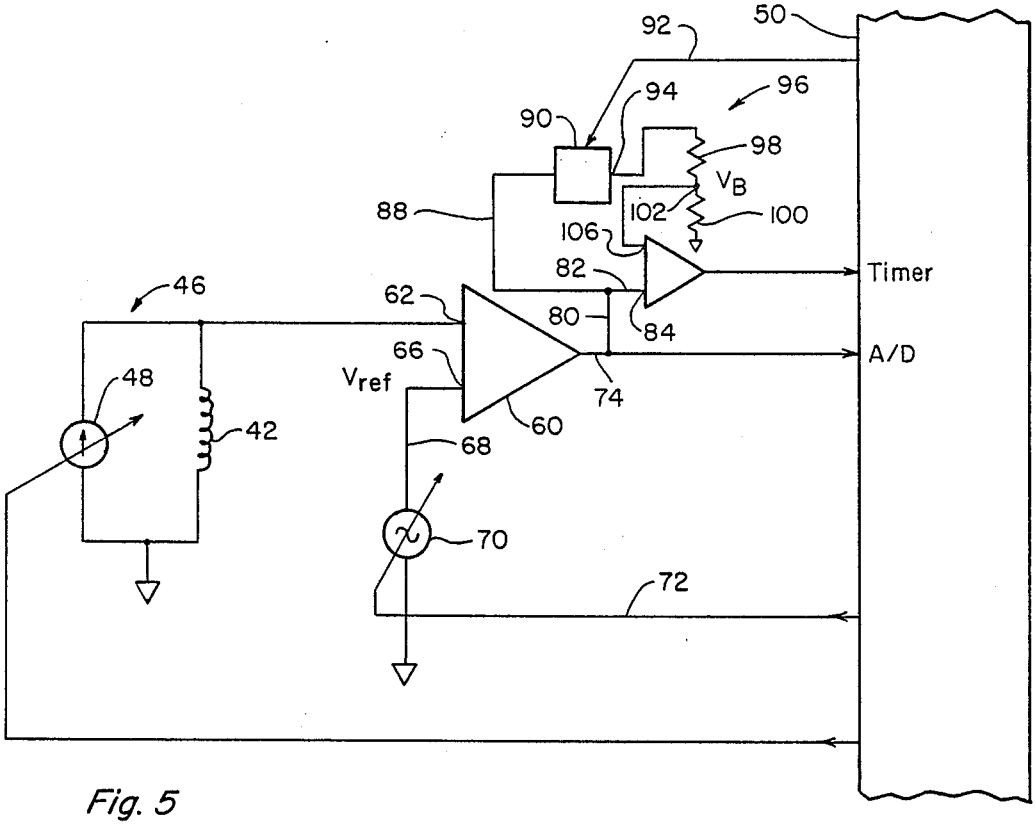
FIG. 5 is, a diagram depicting in greater detail than FIG. 1 a preferred embodiment of the coin detection means of the present invention.

With such a background, it is now appropriate to turn our attention to FIG. 5, which figure depicts in greater detail than FIG. 1 a particular embodiment of the coin detection means of the present invention that can be advantageously utilized to determine $tau_c$ values for deposited coins, especially coins of low magnetic permeability. For discussion purposes with regard to FIG. 5, it is most appropriate to presume that some means for detecting and/or separating coins of high magnetic permeability is employed prior to examination of the remaining low magnetic permeability coins by the FIG. 5 embodiment. In such FIG. 5 embodiment the detector means 52 of the FIG. 1 embodiment is shown including a differential amplifier means 60 having a first input 62 connected via lead 64 to circuit 46 to monitor the voltage present across sensor coil 42 and a second input 66 connected via lead 68 to a reference signal generator 70 which is controlled by reference adjust data provided thereto by control means 50 via data path 72. The output 74 of differential amplifier means 60 is connected, first, via lead 76 to an A/D input 78 of control means 50, secondly, via leads 80 and 82 to input 84 of a comparator 86, and, thirdly, via leads 80 and 88 to a sample and hold means 90 which is controlled by a sample control signal supplied thereto over lead 92 from control means 50. The output 94 of sample and hold means 90 is connected to a voltage divider circuit 96 which includes resistors 98 and 100 and a pick-off point 102 between such resistors, from which point 102 a lead 104 is connected to the second input 106 of comparator 86, the output 108 of which is connected via lead 110 to a timer input 112 of control means 50.

In operation, when no coin is present within the field of the sensor coil 42, the resulting voltage $V_s$ across the sensor coil following the application of a current ramp $I=k_1t$ to the coil will be $k_1L_s+k_1R_st$, and the reference voltage $V_{ref}$ produced by the reference signal generator 70 under control of reference signal data provided to such reference signal generator from the control means 50 will ideally also be maintained at a value essentially equal to $k_1L_s+k_1R_st$, as a consequence of which the output of differential amplifier means 60 will be maintained at a null reference value, which, for the present, can be considered to be essentially zero. The control means 50, which may take many forms, including that of a programmed microprocessor, is so constructed, designed, and/or programmed that, so long as the output of differential amplifier means 60 remains at essentially the null reference value, such control means recognizes that no detection of a deposited coin by the coin detection means of the present invention has occurred and no processing of information therefrom is necessary for purposes of coin validation and/or discrimination.

On the other hand, if a coin is present within the field of the sensor coil 42 when a current ramp $I=k_1t$ is produced by the current ramp generator under control of control means 50 and applied to the sensor coil, the resulting voltage across the coil will be $V_{s(cp)}=k_1L_s+k_1R_st-k_2e^{-t/tau_c}$ while the reference voltage will remain $V_{ref}=k_1L_s+k_1R_st$, as a consequence of which the output of the differential amplifier means 60 will be $V_{diff}(t)=k_2e^{-t/tau_c}$. The control means 50 may be so constructed, designed, and/or programmed to respond to such change in value of the $V_{diff}(t)$ signal to effect the production of a sample control signal on lead 92 to cause sample and hold means 90 to sample the $V_{diff}(t)$ signal being provided thereto via leads 80 and 88 at such time, designated $T_A$, and to thereafter maintain such sampled value $V_{S\&H}=V_{diff}(T_A)=V_A$ on output 94 of sample and hold means 90. Such $V_A$ value, which is also available at the time of sampling at A/D input 78 of control means 50, may be stored or otherwise maintained by the control means 50 for future reference and use. The control means may also employ a timer started in some fashion at time $T_A$, or it may store or otherwise maintain a $T_A$ value for future reference and use. With the FIG. 5 embodiment, when $V_{S\&H}=V_A$ is established and thereafter maintained on output 94 of sample and hold means 90, a lower voltage, designated $V_B$, is established and thereafter maintained on input 106 of comparator means 86 due to voltage divider circuit 96. Such $V_B$ value may also be computed by control means 50, from the $V_A$ value and known component values of resistors 98 and 100, and stored or otherwise retained by the control means for future reference and use. So long as $V_{diff}(t)$ is greater than $V_B$, i.e., $V_{diff}(t)>V_B$, the output of comparator means 86 will remain HI. When the value of $V_{diff}(t)$ has decayed such that $V_{diff}(t)$ is less than or equal to $V_B$, i.e., $V_{diff}(t)\leqq V_B$, the output of comparator means 86 will go LO. The time at which such change from a HI to a LO in the output state of comparator means 86 occurs is designated $T_B$. The control means 50 may be so constructed, designed, and/or programmed to respond to such change of state, detectable at timer input 112, to cause the timer started at time $T_A$ to stop, or to otherwise establish and store or otherwise maintain a $T_B$ value for future reference and use.

It will be appreciated by those skilled in the art that the control means 50 can be so constructed, designed, and/or programmed to readily utilize the two time-voltage pairs that are thus obtained for $V_{diff}(t)$, viz., $(T_A,V_A)$ and $(T_B,V_B)$, to derive a $tau_c$ value representative of any coin of low magnetic permeability that undergoes examination by such embodiment. The control means 50 can be further constructed, designed, and/or programmed in any number of ways to thereafter determine whether the particular $tau_c$ value derived represents a valid coin and/or to determine the denomination of the deposited coin. With a microprocessor based control means it is a relatively simple matter to effect comparisons between the derived $tau_c$ value and pre-established coin acceptance values, which values have typically been entered in read/write memories and stored therein for later retrieval and use.

Many known systems operate, through such use of comparisons, to determine whether or not, based upon some measured characteristic of the deposited coin, such coin is a valid coin or is a coin of a particular denomination. As has been discussed hereinbefore, however, with many such systems, because of the tuning requirements associated therewith arising from minor variations in component values from individual construction to individual construction, and the resultant need to be able to enter comparison data that is specific to and correct for a particular construction, the provision of some form of read/write or alterable memories for the storage of such comparison values has been a necessity. With such types of memories, data tailored to a particular construction can be readily entered during tuning to ensure that the system will function properly. Memory alterability also permits the system to be relatively easily adjusted at a later time to correct for circuit drift, which, if not compensated for, could result in unacceptable degradation of performance by such systems over an extended period of time.

While it is entirely feasible and possible to employ programmable or alterable memories in various embodiments of the present invention for the storage of comparison values, such types of memories are not required by the present invention since the tuning of individual constructions can generally be dispensed with. Consequently, and by way of example, with the present invention the comparison values can be provided in a masked ROM or can be established by hardwiring, both of which options avoid the necessity for programmable or alterable memory as the storage medium for the comparison values. It will be understood that, while such advantage is not at the heart of the present invention, because of the independence of the derived $tau_c$ characteristic from system component values and variations therein, from coin-to-coil distances when the coin is within the field of the sensor coil, and from other miscellaneous factors which may vary from individual construction to individual construction for any given system, the realization of such advantage may optionally be readily achieved through an appropriate design of the control means.

Figure 6:
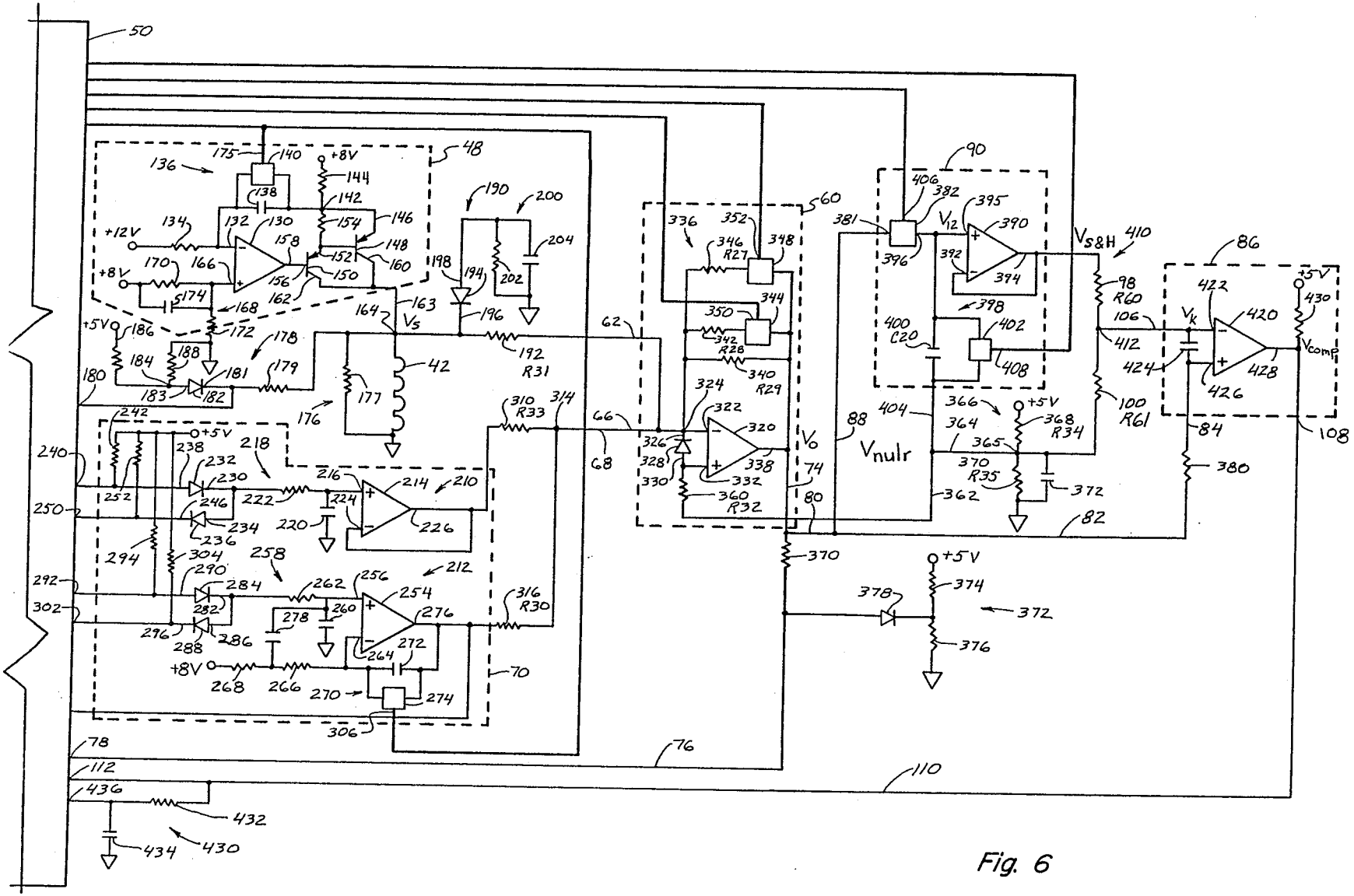
FIG. 6 is a schematic for a particular embodiment constructed in general accordance with FIG. 5.

FIG. 6 depicts in greater detail an embodiment of the coin detection means of the present invention constructed in general accordance with FIG. 5, and FIGS. 7–9 are enlargements of certain portions of FIG. 6 provided for purposes of clarification and explanation. For explanation purposes, certain of the numbered circuit components in FIG. 6 are also identified by alternate designations in FIGS. 7–9, which alternate designations will generally be found hereinafter set forth in parentheses following the numerical designation.

Figure 7:
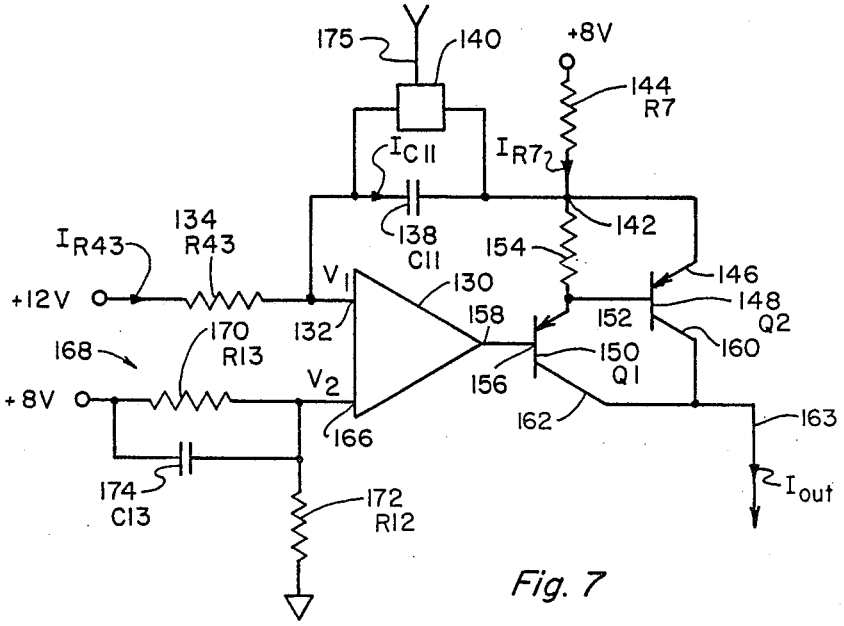
FIGS. 7–9 are schematics showing, in enlargement, certain portions of FIG. 6.

The current ramp generator 48 is depicted in FIGS. 6 and 7 as including an operational amplifier 130 whose inverting input (−) 132 is connected through resistor 134 ($R_{43}$) to a +12 V source and through circuit portion 136, which includes capacitor 138 ($C_{11}$) and switch means 140 connected in parallel with one another, to node 142, which node is shown connected to a +8 V source through resistor 144 ($R_7$), to the emitter 146 of a transistor 148 ($Q_2$) which is connected in a Darlington configuration with transistor 150 ($Q_1$), and to the emitter 152 of transistor 150 through resistor 154. The base 156 of transistor 150 is connected to the output 158 of operational amplifier 130, and the collectors 160 and 162 of such transistors 148 and 150 are tied together and connected via lead 163 to node 164. The non-inverting input (+) 166 of such operational amplifier 130 is connected to a +8 V source through attenuator circuit 168, which circuit includes resistors 170 ($R_{13}$) and 172 ($R_{12}$) and a capacitor 174 ($C_{13}$) connected in parallel with resistor 170. The switch means 140, which might typically take the form of an FET, is depicted including a control input 175 connected to receive control signals from the system control means 50.

With particular reference now to FIG. 7, those skilled in the art will readily understand that the voltage $V_2$ at non-inverting input (+) 166 of operational amplifier 130 satisfies the equation $V_2=[R_{12}/(R_{12}+R_{13})]8$, that $I_{out}=I_{R7}$ due to the high gain of the Darlington pair $Q_1$ and $Q_2$, and that the operational amplifier 130 acts to force the voltage $V_1$ at the inverting input (−) 132 thereof to be equal to the voltage $V_2$ at the non-inverting input (+) 166 thereof at all times. So long as the switch means 140 remains closed, the shunt path through such switch means ensures that the voltage $V_3$ at node 142 remains essentially equal to the voltage $V_1$ at inverting input (−) 132 of operational amplifier 130, as a consequence of which $V_3=V_1=V_2$. The voltage drop across resistor 144 ($R_7$) at such time will therefore be $8-V_3=8-V_2=8-[R_{12}/(R_{12}+R_{13})]8=8(1-[R_{12}/(R_{12}+R_{13}))])$. and the current through resistor 144 ($R_7$) will thus be $I_{R7}=8(1-[R_{12}/(R_{12}+R_{13})])/R_7$. Since $I_{out}=I_{R7}$ the output current produced by the current ramp generator 50 of FIGS. 6 and 7 while the switch means 140 remains closed will be $I_{out}=8(1-[R_{12}/(R_{12}+R_{13})])/R_7=8[R_{13}/(R_{12}+R_{13})]/R_7$. Ideally, $I_{out}$ would equal zero, which would be the case if $R_{13}$ were equal to zero or $R_{12}$ were equal to infinity. As a practical matter, however, $R_{12}$ and $R_{13}$ are selected to have values such that a small bias current, typically on the order of approximately 6 ma., is produced, which bias current serves to improve the response rate of the current ramp generator.

When the switch means 140 opens, the shunt path through such switch means is eliminated, with the result that the current $I_{C11}$ through capacitor 138 ($C_{11}$) will thereafter be essentially the same as the current $I_{R43}$ through resistor 134 ($R_{43}$), i.e., $I_{C11}=I_{R43}$. Since $$V_1=V_2=[R_{12}/(R_{12}+R_{13})])8,$$

$$I_{R43}=(12-V_1)/R_{43}=(12-[R_{12}+R_{13})]8)/R_{43},$$

and $$I_{C11}=C_{11}d(V_1-V_3)/dt=C_{11}d([R_{12}/(R_{12}+R_{13})]8-V_3)/dt.$$

Therefore, $$[R_{12}/(R_{12}+R_{13})]8-V_3=1/C_{11}\,{}^{t}I_{C11}dt,$$

and $$\begin{aligned} V_3 &= ([R_{12}/(R_{12}+R_{13})]8) - 1/C_{11}\,{}^{t}I_{C11}dt \\ &= ([R_{12}/(R_{12}+R_{13})]8) - 1/C_{11}\,{}^{t}I_{R43}dt \\ &= ([R_{12}/(R_{12}+R_{13})]8) - 1/C_{11}\,{}^{t}[(12 - [R_{12}/(R_{12}+R_{13})]8)/R_{43}]dt \\ &= ([R_{12}/(R_{12}+R_{13})]8) - 1/C_{11}[(12 - [R_{12}/(R_{12}+R_{13})]8)/R_{43}]t, \end{aligned}$$

taking the opening of switch means 140 as time $t_0=0$. The current $I_{R7}$ through resistor 144 ($R_7$) can then be expressed as $I_{R7}=(8-V_3)/R_7$, or, substituting for $V_3$, $$I_{R7}=[8-([(R_{12}/[R_{12}+R_{13}])8]-1/C_{11}[(12-[R_{12}/(R_{12}+R_{13})]8)/R_{43}]t()/R_7,$$

which can be rewritten in a more simplified form as $$I_{R7}=(8/R_7)(1-[R_{12}/(R_{12}+R_{13})])+(8t/R_7C_{11}R_{43}.)(1.5-[R_{12}/(R_{12}+R_{13})]).$$

Since $I_{out}=I_{R7}$, as previously discussed, it is thus the case that $$I_{out}=(8/R_7)(1-[R_{12}/(R_{12}+R_{13})])+(8t/R_7C_{11}R_{43}.)(1.5-[R_{12}/(R_{12}+R_{13})]).$$

Figure 10:
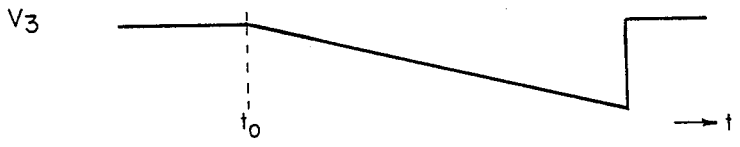
FIGS. 10–16 depict certain circuit waveforms at various points in the embodiment of FIG. 6.
Figure 11:
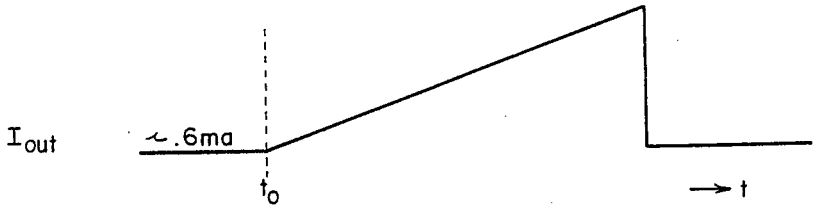

Typically, the values of $R_7$, $R_{12}$, and $R_{13}$ might be selected to yield a current $I_{out}$ approximately equal to 0.55 ma. per microsecond times the time, i.e., $I_{out}$=(0.55 ma./us)t. FIGS. 10 and 11 depict typical waveforms for $V_3$ and $I_{out}$, consistent with the foregoing discussion.

Figure 8:
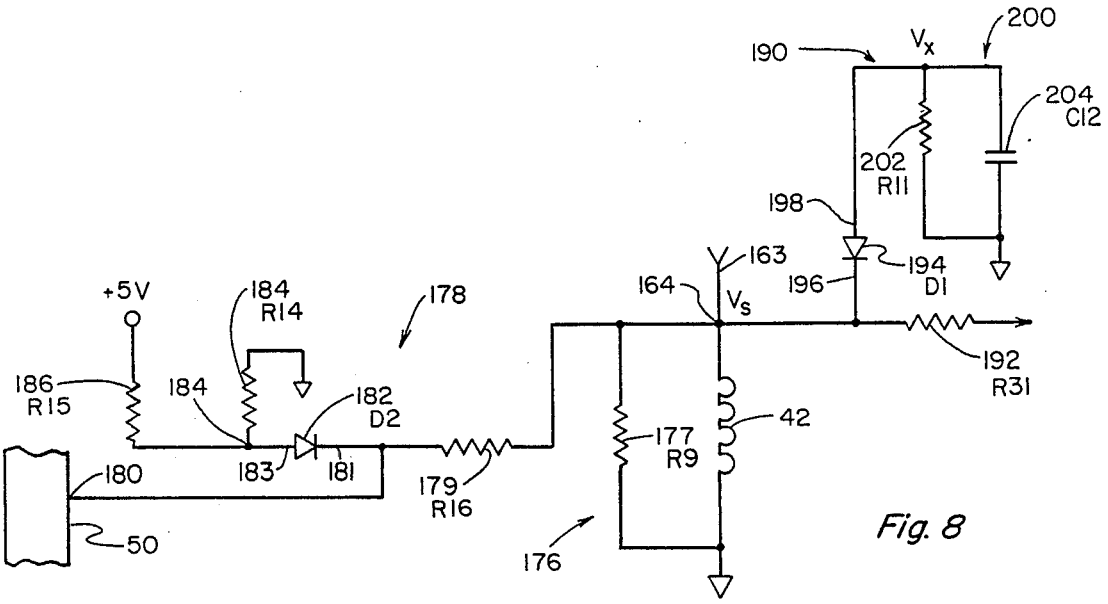

With reference next to FIGS. 6 and 8, it may be observed that node 164 is connected to one side of an RL circuit 176 that includes sensor coil 42 and a resistor 177 ($R_9$) connected in parallel therewith, the other side of which circuit 176 is connected to ground. It will be appreciated by those skilled in the art that resistor 177 ($R_9$) is not required for proper operation of the depicted construction, but is provided as an optional element to help reduce self oscillation of the sensor coil 42 and to thereby effect an improvement in system performance.

Node 164 is also shown connected to an input protection circuit 178 that includes a resistor 179 ($R_{16}$), one side of which is connected to node 164 and the other side of which is connected both to input 180 of the control means 50 and to the cathode 181 of a diode 182 ($D_2$) The anode 183 of such diode is connected to node 184 in a voltage divider circuit wherein node 184 is connected between a resistor 186 ($R_{15}$) tied to a +5 V source and a grounded resistor 188 ($R_{14}$). Like resistor 177, circuit 178 is similarly not required, but is depicted for the purpose of showing an optional input protection circuit that may be advantageously employed when it is desired to be able to supply $V_s(t)$ to the control means 50, which control means might typically include a Motorola 6805R3 microprocessor, while ensuring that the input voltage supplied to the microprocessor will not exceed the input range of the microprocessor. Those skilled in the art will readily understand that the circuit 178 acts to limit the voltage supplied as an input to system control means 50 when the value of $V_s(t)$ exceeds a voltage determined by the values of resistors 174 ($R_{16}$), 186 ($R_{15}$), and 188 ($R_{14}$) in order to ensure that the voltage level supplied will be within the input range of the microprocessor utilized. It should be understood that, for proper operation of the disclosed construction, it is not necessary that $V_s(t)$ be provided to the control means in any way, and that the provision of such signal as depicted in FIGS. 6 and 8 is for the purpose of indicating that such signal could be readily provided to the control means, if desired for informational purposes.

In addition to the connections previously noted, node 164 is also connected both to a kickback protection circuit 190 and through a resistor 192 ($R_{31}$) to input 62 of differential amplifier means 60. The kickback protection circuit 190 includes a diode 194 ($D_1$), the cathode 196 of which is connected to node 164 and the anode 198 of which is connected to a grounded RC tank circuit 200 that includes resistor 202 ($R_{11}$) and capacitor 204 ($C_{12}$) It will be readily understood that the circuit 190 is an optional circuit, the purpose of which is to absorb and dissipate the kickback of the sensor coil 42 when the current ramp is turned off. As provided, such circuit has no effect upon $V_s$ during the time that the ramp current generator 48 is supplying a ramp current to sensor coil 42.

Figure 12:
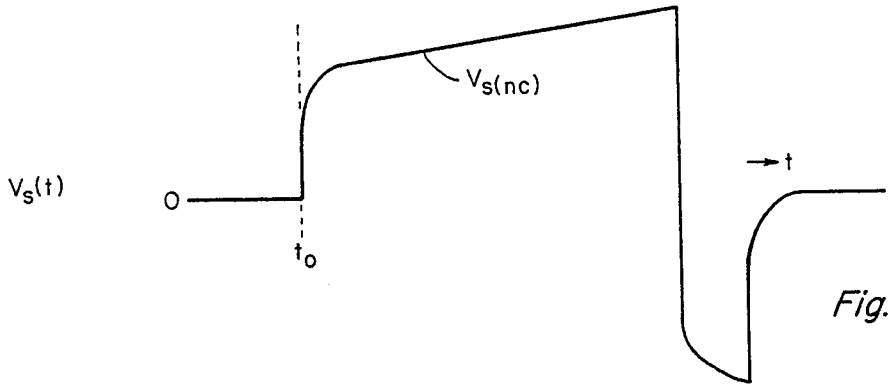
Figure 13:
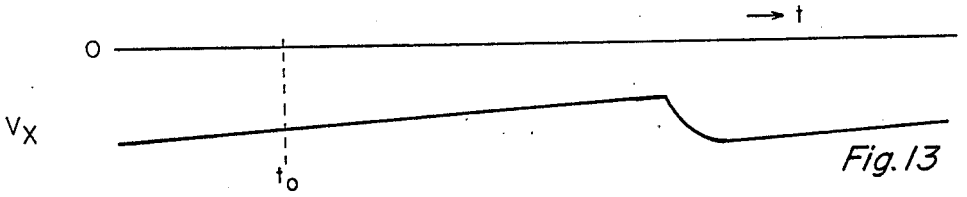

With the foregoing in mind it will be appreciated that FIG. 12 depicts a typical $V_{s(nc)}$ waveform such as might be obtained when resistor 177 is employed, and also illustrates the kickback that occurs when the current ramp is disabled. FIG. 13 illustrates, in combination with FIG. 12, the effect of kickback protection circuit 190 in providing kickback protection.

Figure 9:
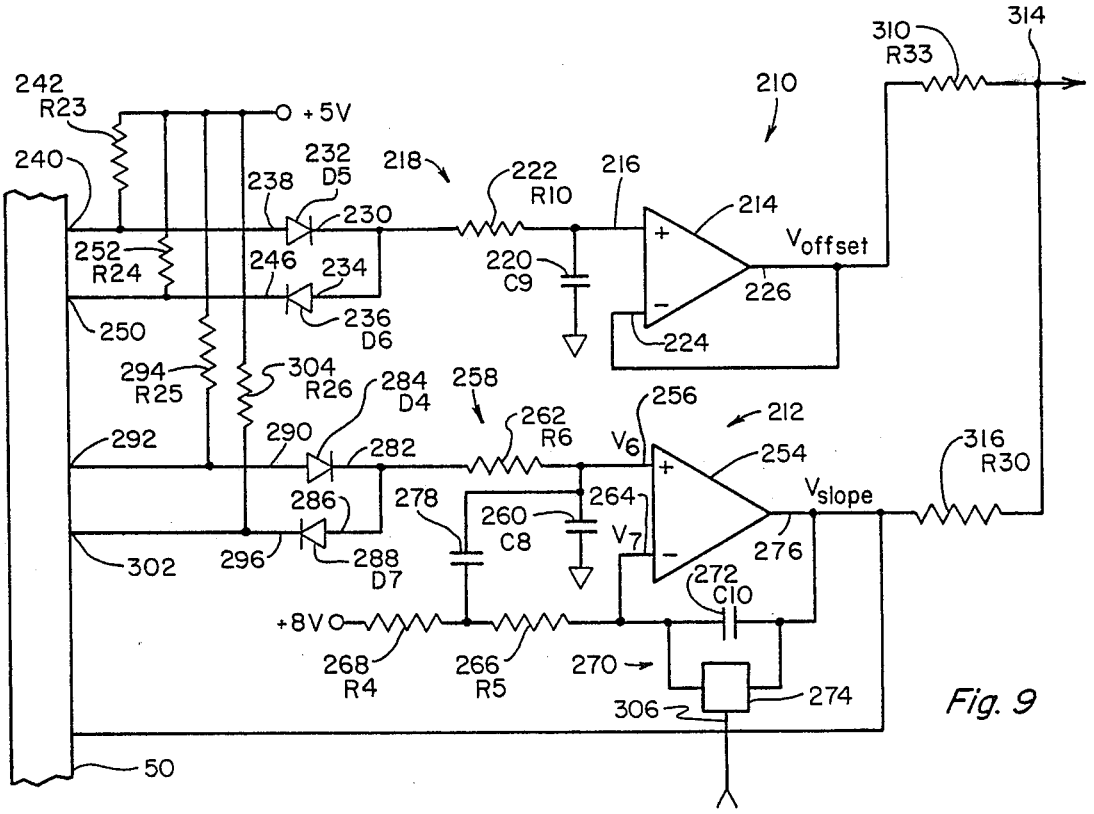
Figure 14:
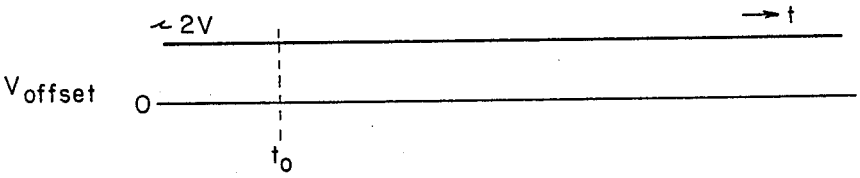

With reference now again to FIG. 6, as well as to FIG. 9, the reference signal generator 70 is depicted as including an offset reference portion 210 and a slope reference portion 212. The offset reference portion 210 is designed to provide a DC output voltage $V_{offset}$, the purpose of which is to effectively "cancel out" all DC offsets of the system. Such depicted offset reference portion 210 includes an operational amplifier 214 connected as a voltage follower with its non-inverting input (+) 216 connected to receive the output of a band pass filter 218 that includes capacitor 220 ($C_9$) and resistor 222 ($R_{10}$) and with its inverting input (−) 224 connected to amplifier output 226. The input of the band pass filter 218 is connected to both the cathode 230 of a first diode 232 ($D_5$) and the anode 234 of a second diode 236 ($D_6$) The anode 238 of the first diode 232 is connected both to output 240 of system control means 50 and through a pull-up resistor 242 ($R_{23}$) to a +5 V source, and the cathode 246 of the second diode 236 is similarly connected both to output 250 of system control means 50 and through pull-up resistor 252 ($R_{24}$) to the +5 V source. Adjustments in the value of $V_{offset}$ are effected by the production of signals at outputs 240 and 250 of the system control means 50. If an increase in the value of $V_{offset}$ is desired, HI signals are produced on both of outputs 240 and 250, as a consequence of which capacitor 220 will gradually charge thereby resulting in a gradual increase in the value of $V_{offset}$. If a decrease in the value of $V_{offset}$ is desired, LO signals are produced on both of outputs 240 and 250, as a consequence of which capacitor 220 will slowly discharge thereby resulting in a gradual decrease in the value of $V_{offset}$. To maintain the value of $V_{offset}$, it is generally desirable to provide a LO signal at output 240 and a HI signal at output 250 in order to ensure that no charging or discharging of the capacitor 220 will occur. FIG. 14 depicts a typical $V_{offset}$ waveform.

The slope reference portion 212 includes an operational amplifier 254 whose non-inverting input (+) 256 is connected to receive the output of a band pass filter 258 that includes capacitor 260 ($C_8$) and resistor 262 ($R_6$) and whose inverting input (−) 264 is connected through resistors 266 ($R_5$) and 268 ($R_4$) to a +8 V source and through circuit portion 270, which includes capacitor 272 ($C_{10}$) and switch means 274 connected in parallel with one another, to amplifier output 276. The input of such band pass filter 258 is connected to both the cathode 282 of a first diode 284 and the anode 286 of a second diode 288. The anode 290 of the first diode 284 is connected both to output 292 of system control means 50 and through a pull-up resistor 294 ($R_{25}$) to a +5 V source, and the cathode 296 of the second diode 288 is similarly connected both to output 302 of system control means 50 and through pull-up resistor 304 ($R_{26}$) to the +5 V source.

Another capacitor 278 is provided with one side connected between resistors 266 ($R_5$) and 268 ($R_4$) and with the other side thereof connected between resistor 262 ($R_6$) and capacitor 260 ($C_8$), the purpose of which capacitor is to minimize noise on the inputs of the differential amplifier. Such capacitor 278 is preferably chosen, if employed at all, to have such a value in relation to other components that noise minimization can be realized through the use of such capacitor and without any other appreciable effect upon circuit performance.

The switch means 274, which might typically take the form of an FET, is depicted including a control input 306 connected to receive control signals from the system control means 50. At times prior to $t_o$, i.e., at times prior to generation of a current ramp by the current ramp generator 48, switch means 274 remains closed, as a consequence of which $V_{slope}$ is maintained at some constant DC voltage, typically approximately 3 V, equal to the voltage $V_6$ present at input 256 of amplifier 254 and across capacitor 260, and $V_7=V_6$. Those skilled in the art will understand that, when the switch means 274 opens at time $t_o$, the shunt across capacitor 272 is removed and the value of $V_{slope}$ will thereafter satisfy the equation $V_{slope}=V_6\text{-}At$, where A is a gain factor approximately equal to $(8-V_6)/[(R_4+R_5)C_{10}]$. Consequently, after the switch means 274 has opened, $V_{slope}=V_6-[(8-V_6)/[(R_4+R_5)C_{10}]]t$.

Figure 15:
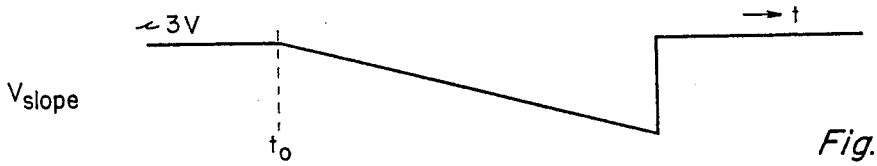

The value of $V_6$ can be readily adjusted under control of system control means 50 in much the same way $V_{offset}$ is adjusted, based upon the signals provided at outputs 292 and 302 of system control means 50. FIG. 15 depicts a typical $V_{slope}$ waveform.

Output 226 of operational amplifier 214 and output 276 of operational amplifier 254 are connected through respective resistors 310 ($R_{33}$) and 316 ($R_{30}$) to summing node 314, at which is present the composite reference signal $V_{ref}=V_{offset}+V_{slope}$ that is provided via lead 68 to input 66 of differential amplifier means 60. The differential amplifier means 60 of FIG. 5 is depicted in FIG. 6 as including a differential amplifier 320 the inverting input (−) 322 of which is connected, in common, at node 324, through summing node 325, to inputs 62 and 66 of differential amplifier means 60, to cathode 326 of a diode 328 whose anode 330 is connected to the non-inverting input (+) 332 of such differential amplifier 320, and to one side of a circuit portion 336, the other side of which is connected to output 338 of such differential amplifier 320. Circuit portion 336 includes resistor 340 ($R_{29}$) connected in parallel circuit with two separate resistor-switch series circuits, the first of which includes a resistor 342 ($R_{28}$) connected in series circuit with an switch means 344 and the second of which includes a resistor 346 ($R_{27}$) connected in series circuit with a switch means 348. The switch means 344 and 348, which might typically take the form of FETs, are depicted including respective control inputs 350 and 352 connected to receive control signals from the system control means 50. The non-inverting input (+) 332 of differential amplifier 320, in addition to being connected to the anode 330 of diode 328, is connected through resistor 360 ($R_{32}$) and leads 362 and 364 to node 365 of a voltage divider circuit 366 that includes resistors 368 ($R_{34}$) and 370 ($R_{35}$) connected between a +5 V source and ground, with a capacitor 372 connected in parallel circuit with resistor 370.

Differential amplifier 320 functions as a classical summing amplifier using variable gain, where the gain is determined in large part by the status of switch means 344 and 348. If both of such switch means are open, the effective resistance $R_{eff}$ of circuit portion 336 is $R_{29}$, whereas, if switch means 344 is closed and switch means 348 is open, $R_{eff}=1/[(1/R_{29})+(1/R_{28})]=(R_{29}R_{28})/(R_{29}+R_{28})$, and if both switch means are open, $R_{eff}=1/[(1/R_{29})+(1/R_{28})+(1/R_{27})]$. Those skilled in the art will recognize that, with the circuit configuration depicted in FIG. 6, the voltage $V_o$ at output 338 of differential amplifier 320 will satisfy the equation $V_o=V_{nulr}-[(V_s-V_{nulr})/R_{31}+(V_{offset}-V_{nulr})/R_{33}+(V_{slope}-V_{nulr})/R_{30}]R_{eff}$, where $V_{nulr}$ is the null reference voltage value at non-inverting input (+) 332 of differential amplifier 320. It will be appreciated that component values may be so chosen and $V_{offset}$, $V_{slope}$, and $V_{nulr}$ so set that, in the absence of a coin, $V_o=V_{nulr}$, which value, in the embodiment of FIG. 6, may typically be approximately 2.5 V. Such values may be further chosen and set, consistent with the foregoing teachings, such that $V_o(t)=V_{nulr}+k_2e_c^{(-t/tau)}-K_o(c)$, which can be considered to be simply $V_o(t)=V_{nulr}+k_2e^{(-t/tauc)}$ for a coin of low magnetic permeability since $K_o(c)$ for such coins is essentially zero.

The purpose of the switch means 344 and 348 and the reasons for providing for variable gain for the differential amplifier 320 will be addressed in greater detail hereinafter. For ease of discussion and understanding at this point, it may be presumed that switch means 344 and 348 remain open and that the effective resistance $R_{eff}$ of circuit portion 336 remains equal to $R_{29}$ at all times of interest.

The output 338 of differential amplifier 320 is shown connected through lead 74, resistor 370, and lead 76 to input 78 of system control means 50, the purpose of which input has been previously explained with reference to FIG. 5. The voltage divider circuit 372, including resistors 374 and 376 connected between a +5 V source and ground, and diode 378, is provided as shown in order to limit the voltage value supplied to input 78 of system control means 50. Output 338 is further connected through leads 74, 80, 82 and resistor 380 to input 84 of comparator means 86 and through leads 74, 80, and 88 to one side 381 of a switch means 382 of sample and hold means 90.

Depicted within sample and hold means 90 is an operational amplifier 390 shown connected as a voltage follower with its inverting input (−) 392 connected to its output 394 and with its non-inverting input (+) 395 connected both to the second side 396 of switch means 382 and to one side of a circuit portion 398 that includes a capacitor 400 ($C_{20}$) connected in parallel with switch means 402, the other side of which circuit portion 398 is connected through leads 404 and 364 to node 365 of voltage divider circuit 366. Switch means 382 has a control input 406 connected to receive control signals from system control means 50, and switch means 402 has a control input 408 similarly connected to the system control means to receive control signals therefrom.

The operation of sample and hold means 90 is dependent upon the status of switch means 382 and 402. If switch means 382 is maintained open and switch means 402 is maintained closed, the sample and hold means 90 is in a nulling mode of operation in which the voltage $V_{12}$ at non-inverting input (+) 395 is equal to $V_{nulr}$ as established by voltage divider circuit 366 due to the shunting action of switch means 402. Since operational amplifier 390 is connected in a voltage follower configuration the output $V_{S\&H}$ thereof is maintained essentially equal to $V_{12}$, i.e., $V_{S\&H}=V_{12}=V_{nulr}$, during such nulling mode of operation. If switch means 402 is maintained open, however, sample and hold means 90 operates to sample $V_o(t)$ at a given point in time, i.e., when switch means 382 briefly closes and re-opens, and sample and hold means 90 thereafter maintains or holds a voltage value corresponding to such sampled $V_o(t)$ value at output 394 of operational amplifier 390 until the next sample of $V_o(t)$ is taken.

Output 394 of operational amplifier 390 is connected to one side of a voltage divider circuit 410 that includes resistor 98 ($R_{60}$), node 412, and resistor 100 ($R_{61}$), the other side of which circuit is connected to node 365, which node is maintained at $V_{nulr}$. Node 412 is connected to input 106 of comparator 86, which is depicted in FIG. 6 as an operational amplifier 420 whose inverting input (−) 422 is connected both to input 106 and to one side of a capacitor 424 and whose non-inverting input (+) 426 is connected both to the other side of such capacitor 424 and to input 84 of comparator means 86. Output 428 of such operational amplifier 420 is connected both to output 108 of comparator means 86 and through a pull-up resistor 430 to a +5 V source. Output 108 is connected through lead 110 to timing input 112 of system control means 50 and through lead 110 and low pass filter circuit 430, including resistor 432 and grounded capacitor 434, to input 436 of system control means 50. With such a configuration the voltage $V_{comp}(t)$ at output 428 of operational amplifier 420 will remain HI so long as $V_o(t)$ is greater than $V_k$, i.e., $V_o(t)>V_k$, and will go LO when $V_o(t)$ falls below $V_k$, i.e., $V_o(t)<V_k$. It will be understood by those skilled in the art that $V_k=V_{nulr}$ when sample and hold means 90 is in a nulling mode. By monitoring $V_{comp}(t)$ during such nulling mode system control means 50 can determine whether the values of $V_{offset}$ and $V_{slope}$ have been appropriately adjusted so that $V_o(t)=V_{nulr}$. If not, adjustments in such values may be effected under control of system control means 50 in the manner previously described.

Figure 16:
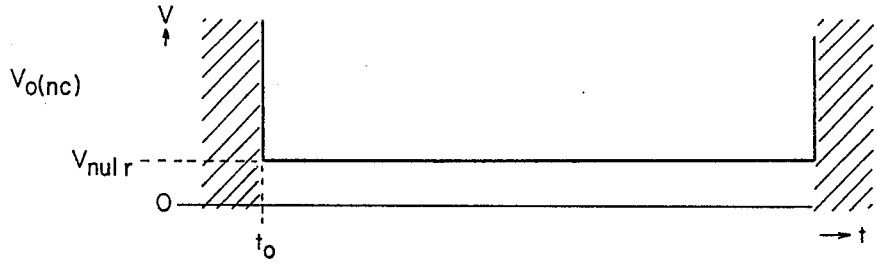
Figure 17:
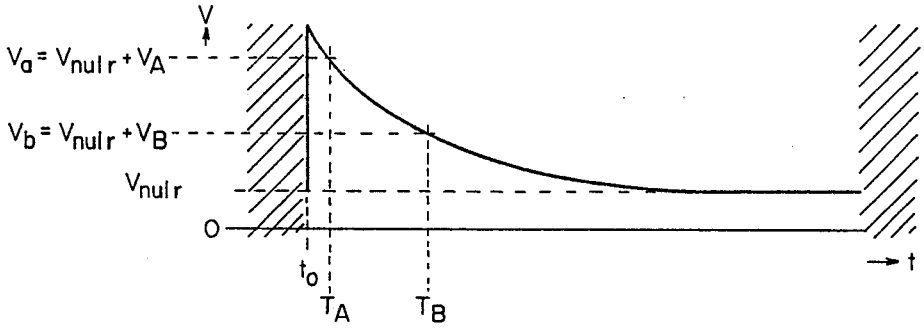
FIGS. 17–18 depict certain resultant circuit characteristic waveforms when a coin of low magnetic permeability is detected by the embodiment of FIG. 6.
Figure 18:
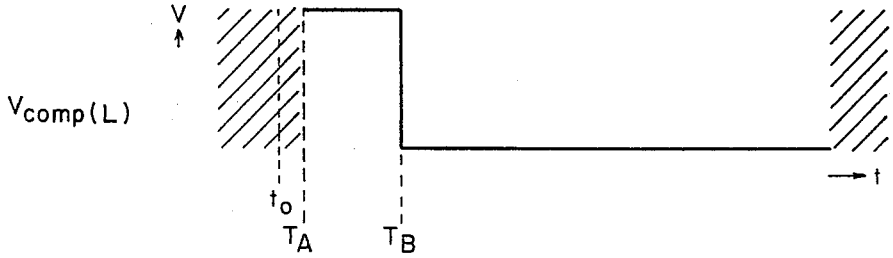

In light of the preceding discussion, it will be appreciated that, during a coin detection operation cycle, if no coin is present within the field of coil 42, $V_o(t)=V_{nulr}$, as depicted in FIG. 16, but that, if a coin of low magnetic permeability is present in such field, $V_o(t)=-V_{nulr}+k_2e^{(t/tauc)}$, as depicted in FIG. 17. In the latter case, if switch means 382 closes at time $T_A$, $V_{S\&H}$ is set equal to $V_o(t)$ at time $T_A$, which value is defined as $V_a$, i.e., $V_{S\&H}=V_o(T_A)=V_a=V_{nulr}+V_A$, as a consequence of which $V_k=V_{nulr}+(V_a-V_{nulr})[R_{61}/(R_{60}+R_{61})]$, which becomes $V_k=V_{nulr}+(V_{nulr}+V_A-V_{nulr})[R_{61}/(R_{60}+R_{61})]$, or $V_k=V_{nulr}+V_A[R_{61}/(R_{60}+R_{61})]=V_{nulr}$30 $V_B$, where $V_B=V_A[R_{61}/(R_{60}+R_{61})]$So long as $V_o(t)$ remains greater than $V_k=V_{nulr}+V_B$, i.e., $V_o(t)>V_{nulr}+V_B$, $V_{comp}(t)$ remains HI, but when $V_o(t)$ falls below $V_k=V_{nulr}+V_B$, i.e., $V_o(t)<V_{nulr}+V_B$, which first occurs at a time defined as $T_B$, $V_{comp}(t)$ goes LO, as depicted in FIG. 18. Since a voltage value corresponding to $V_o(t)$ is provided to input 78 of system control means 50, it is a relatively simple matter for the system control means 50 to monitor such signal during a coin detection operation cycle, and, if $V_o(t)$ exceeds $V_{nulr}$, i.e., if $V_o(t)>V_{nulr}$, to effect the momentary closure of switch 382 at a time $T_A$. By monitoring the $V_{comp}(t)$ signal provided to input 112 of system control means 50, such system control means can readily determine the time $T_B$ at which $V_{comp}(t)$ goes LO, which change in state of $V_{comp}(t)$ occurs when $V_B=V_A[R_{61}/(R_{60}+R_{61})]$. Since times $T_A$ and $T_B$ will then be known, and since $V_A/V_B=(R_{60}+R_{61})/R_{61}$, system control means 50 can then readily derive $tau_c$ for such coin from the equation $$tau_c=[(T_B-T_A)/ln(V_A/V_B)]=((T_B-T_A)/ln[(R_{60}+R_{61})/R_{61}]).$$

From the foregoing, it should be readily apparent that the embodiment of FIG. 6 can be employed to derive $tau_c$ values for coins of low magnetic permeability and to differentiate between valid and invalid coins and between denominations of valid coins. Such differentiation can be accomplished for any given low magnetic permeability coin from a single coin detection operation cycle, although it has been found preferable to utilize a plurality of coin detection operation cycles for each coin to provide further verification of differentiation results. If such FIG. 6 embodiment is utilized in a multiple cycle coin detection environment, which can be easily effected under control of the system control means 50, it then becomes possible with such embodiment to derive $tau_c$ values for coins of both low and high magnetic permeability. It will be recalled from discussions hereinbefore with regard to FIG. 4 that $V_{diff(L)}$ remains positive while $V_{diff(H)}$ eventually goes negative with respect to the base reference value, there taken to be essentially zero. As a consequence, when such $V_{diff(H)}$ waveform is provided to differential comparator means 60 along with $V_{offset}$ and $V_{slope}$, the resulting waveform for $V_{o(H)}$ takes the form depicted in FIG. 19 instead of the $V_{o(L)}$ waveform depicted in FIG. 17. As can be readily observed from FIG. 19, $V_{o(L)}$ thus goes negative with respect to $V_{nulr}$ at a time designated $t_1$. Since a voltage value corresponding to $V_o(t)$ is provided to input 78 of system control means 50, the system control means 50 can easily be constructed and/or programmed to monitor such input value during a coin detection operation cycle to determine whether or not a coin is present within the field of sensor coil 42 and, if so, whether such coin is a coin of low or high magnetic permeability. If no 1 coin is present, $V_o(t)$ should remain essentially constant at $V_{nulr}$ (FIG. 16). On the other hand, if a coin is present, $V_o(t)$ should go positive and remain positive with respect to $V_{nulr}$ if the coin is a coin of low magnetic permeability (FIG. 17), but should eventually go negative with respect to $V_{nulr}$ if the coin is a coin of high magnetic permeability (FIG. 19).

It will be appreciated by those skilled in the art that a number of coin detection operation cycles may be controllably effected during the time that any deposited coin is within the field of sensor coil 42. In such circumstances, when the coin first moves within the field of sensor coil 42 the embodiment of FIG. 6 can operate during a first coin detection operation cycle to detect the presence of such coin and to determine whether it is a coin of low or high magnetic permeability. System control means 50 can be readily constructed and/or programmed to be responsive to such determination to thereafter control the operation of switch means 344, 348, and 382 to permit further coin discrimination with respect to both validity and denomination.

If the coin detected is a coin of low magnetic permeability, the FIG. 6 embodiment may thereafter operate in the fashion already previously described to derive a $tau_c$ value for such detected low magnetic permeability coin. On the other hand, if the coin detected is a coin of high magnetic permeability, system control means 50 may be so constructed and/or programmed to thereafter operate and control the operation of the FIG. 6 embodiment during the course of two or more coin detection operation cycles whereby a $tau_c$ value may be derived for such detected high magnetic permeability coin.

Figure 19:
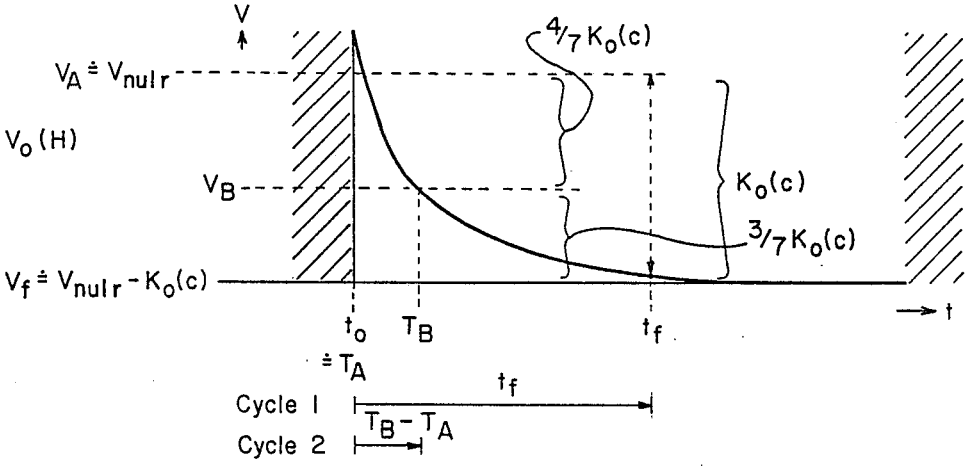
FIGS. 19–20 depict certain resultant circuit characteristic waveforms when a coin of high magnetic permeability is detected by the embodiment of FIG. 6.

It may be observed from FIG. 19 that, since $V_o(t)=-V_{nulr}+k_2e^{(-t/tauc)}-K_o(c)$, $V_{o(H)}$ decays to an end value of essentially $V_{nulr}-K_o(c)$ at time equal to infinity. In light thereof, it has been found that if system control means 50 is so constructed and/or programmed to respond to detection of the presence of a coin of high, as opposed to low, magnetic permeability by appropriately altering the time of operation of switch means 382 of the FIG. 6 embodiment, an approximate $tau_c$ value for such detected high magnetic permeability coin can then be derived during a subsequent coin detection operation cycle through utilization of the FIG. 6 embodiment already previously described. If, for a high magnetic permeability coin, the momentary closure of switch means 382 of the FIG. 6 embodiment is delayed during a first coin detection operation cycle from the relatively early time it would normally close if a low magnetic permeability coin were undergoing examination until a time considerably later in such coin detection operation cycle, and if such switch means 382 is then momentarily closed at such late time, designated as $t_f$, to sample $V_o(t)$, the sampled value of $V_o(t)$ will approximate such noted end value of $V_{nulr}-K_o(c)$ for $V_o(H)$, i.e., $V_{S\&H}=V_o(t_f)=V_f=V_{nulr}-K_o(c)$. As will be apparent from FIG. 6, if $V_{S\&H}=V_{nulr}-K_o(c)$, $V_k$ then satisfies the equation $$\begin{aligned} V_k &= V_f + (V_{nulr} - V_f)[R_{60}/(R_{60} + R_{61})] \\ &= V_{nulr} - K_o(c) + (V_{nulr} - V_{nulr} + K_o(c))[R_{60}/(R_{60} + R_{61})] \\ &= V_{nulr} - K_o(c)(1 - [R_{60}/(R_{60} + R_{61})]). \end{aligned}$$

As can be observed from FIG. 19, at time $t_f$, when the value of $V_k$ is established at the above-noted value, $V_o(t)$ is less than $V_k$, i.e., $V_o(t)<V_k$, and $V_o(t)$ thereafter remains less than $V_k$ for the remainder of such first coin detection operation cycle. Since $V_o(t)$ remains less than $V_k$ for the remainder of such first coin detection operation cycle, $V_{comp}(t)$ will remain LO for the duration of such coin detection operation cycle.

Figure 20:
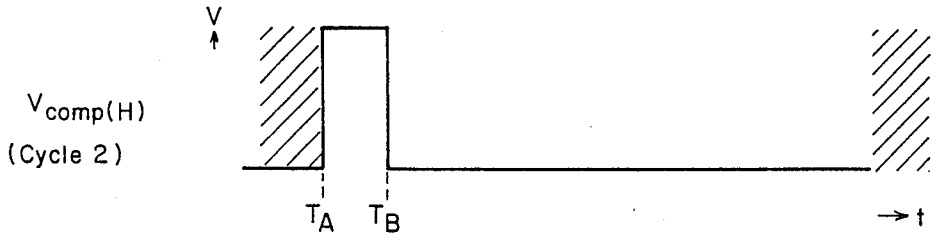

From FIGS. 19 and 20 it may be readily observed that, once $V_k$ is established at time $t_f$ of a first coin detection operation cycle, $V_o(t)$ will not exceed such $V_k$ value until a succeeding coin detection operation cycle. At the beginning of a succeeding coin detection operation cycle $V_o(t)$ will initially go positive with respect to $V_{nulr}$, and will then decay exponentially, eventually approaching the $V_f$ value of $V_{nulr}-K_o(c)$ It has been found that, when switch means 382, during a first coin detection operation cycle, upon the detection of a coin of high magnetic permeability, has operated in the fashion described hereinbefore, time $t_o$ in the succeeding coin detection operation cycle may be considered, at least for many applications where total accuracy in the derivation of $tau_c$ is not critical, to be time $T_A$, and voltage $V_A=V_o(T_A)$ at such time $t_o=T_A$ may be considered to be approximately equal to $V_{nulr}$. Time $T_B$ then becomes that time at which, during such same succeeding coin detection operation cycle, $V_o(t)$ falls below the value of $V_k$ as established based upon the sampled value of $V_o(t)$ at time $t_f$ in the first coin detection operation cycle.

It will be appreciated that, since $V_o(t_f)=V_f$ and $V_f$ is considered to be essentially $V_{nulr}-K_o(c)$, and since $V_A$ is considered to be essentially $V_{nulr}$, the difference between $V_A$ and $V_f$ is $K_o(c)$, i.e., $V_A-V_f=K_o(c)$. In light thereof, and since $V_k=V_{nulr}-K_o(c)(1-[R_{60}/(R_{60}+R_{61})])$, it will further be appreciated that $V_k$ is $(1-[R_{60}/(R_{60}+R_{61})])$th of the voltage differential between $V_f$ and $V_A$, using $V_f$ as reference, as a result of which the value $V_B$, at time $T_B$, may be expressed with reference to $V_A$ as $V_B=V_A[R_{60}/(R_{60}+R_{61})]$. In light of all the foregoing, it will be recognized that, since a voltage value corresponding to $V_o(t)$ is provided to input 78 of system control means 50, it is a simple matter for the system control means 50 to determine a $V_f$ value at time $t_f$ of a first coin detection operation cycle and to thereafter, during a succeeding coin detection operation cycle, determine the time interval $T_B-T_A$ from the $V_{comp}(t)$ output provided to inputs 112 and 436 of system control means 50. As has previously been explained, system control means 50 may then readily derive $tau_c$ for the detected coin from the equation $$tau_c=[(T_B-T_A)/\ln(V_A/V_B)]=((T_B-T_A)/\ln[(R_{60}+R_{61})/R_{60}]).$$

It may be recalled that it was previously indicated that system control means 50 can be so constructed and/or programmed to respond to the input signal provided to input 78 to thereafter control the operation of switch means 344, 348, and 382. As has previously been explained, the gain of differential amplifier means 60 depends, in part, upon the status of switch means 344 and 348. In light thereof it has been found desirable to be able to change the gain of differential amplifier means 60, depending upon whether a low or high magnetic permeability coin is undergoing examination, and consistent with the construction and/or programming of the system control means 50, to take advantage of the full input range available at the inputs for the system control means 50, whereby better resolution may be obtainable. It will be readily understood that such capability to change the gain of differential amplifier means 60 depending upon the magnetic permeability of the coin undergoing examination, though desirable, is not necessary for proper operation of the FIG. 6 embodiment.

Figure 21:
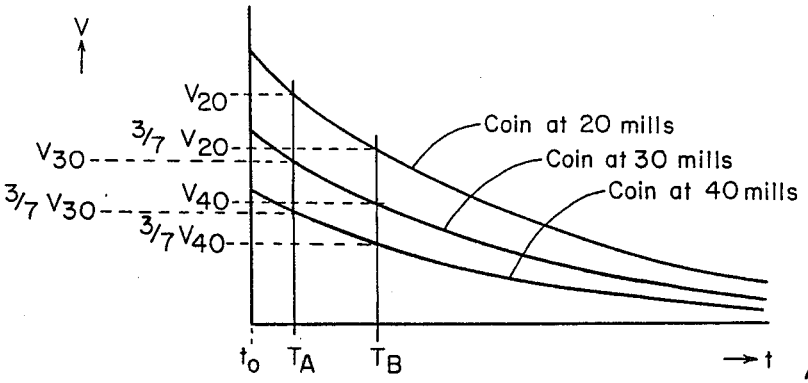
FIG. 21 illustrates how different coin-to-coil distances for a given coin within the field of the sensor coil may typically affect circuit response.
Figure 22:
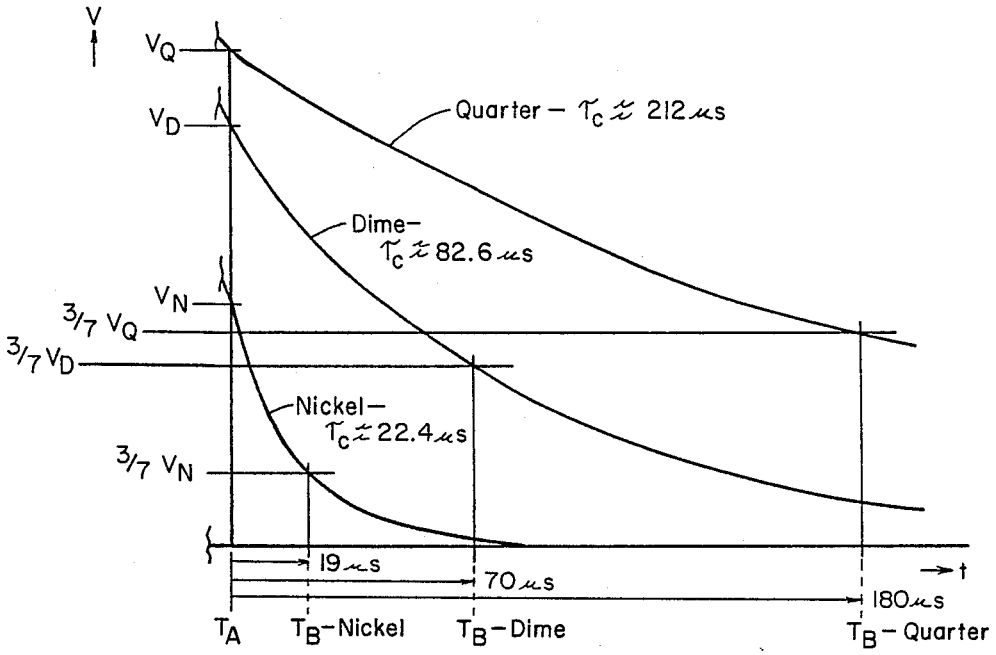
FIG. 22 illustrates how the presence of differently denominated coins within the field of the sensor coil may typically affect circuit response.

FIGS. 21 and 22 depict waveforms corresponding to $V_o(t)$ for various coins detected within the field of sensor coil 42 by a particular FIG. 6 embodiment in which $[R_{61}/(R_{60}+R_{61})]=3/7$, and under certain conditions. FIG. 21 depicts the different waveforms obtained when a low magnetic permeability coin was detected, within the field of the sensor coil 42, during separate coin detection operation cycles, at three different distances, viz., 20 mills (20/1000th of an inch), 30 mills (30/1000th of an inch), and 40 mills (40/1000th of an inch), from the sensor coil 42. Since the same coin was utilized at the three different distances, the $T_A$ sampling time for the coin detection operation cycle at each of such distances, as effected by the momentary closure of switch means 382 under control of the system control means 50, occurred at the same time during each such coin detection operation cycle. The voltage $V_A$ sampled at such time $T_A$, i.e., $V_A=V_o(T_A)$, was used to establish a $V_B$ voltage value for each such coin detection operation cycle in accordance with the equation $V_B=V_A[R_{61}/(R_{60}+R_{61})]=3/7)V_A$. It may be readily observed from FIG. 21 that, for each waveform, the $V_B$ value associated with such waveform occurred at essentially the same time during the coin detection operation cycle as the $V_B$ values associated with the other two waveforms occurred during such other coin detection operation cycles, indicating that the $tau_c$ values for all of such waveforms are essentially equal. Such essential equality of $tau_c$ values for all of such waveforms verifies the relative independence of the derived $tau_c$ value with regard to coin-to-coil distance for a coin present within the field of the sensor coil 42, which independence, as previously discussed, permits coin detection means according to the present invention to be designed and constructed, if one so desires, utilizing only a single sensor coil instead of the plurality of sensor coils required with many prior art constructions.

FIG. 22 depicts portions of different waveforms corresponding to $V_o(t)$ obtained when coins of different denominations, viz., nickel, dime, and quarter, were detected during respective coin detection operation cycles by a particular FIG. 6 embodiment in which $[R_{61}/(R_{60}+R_{61})]=3/7$. Since all of such coins are coins of low magnetic permeability, the $T_A$ sampling times for the respective coin detection operation cycles were all effected at the same time point in each respective coin detection operation cycle. The voltage $V_A$ sampled at time $T_A$ in each respective coin detection operation cycle, i.e., $V_A=V_o(T_A)$, was used to establish a $V_B$ voltage value for such respective coin detection operation cycle in accordance with the equation $V_B=V_A[R_{61}/(R_{60}+R_{61})]=(3/7)V_A$. For each of the waveforms a $T_B$ value was thus determined in accordance with previous discussions, and $tau_c$ was then derived from the equation $$\begin{aligned} tau_c &= [(T_B - T_A)/\ln(V_A/V_B)] \\ &= ((T_B - T_A)/\ln[R_{61}/(R_{60} + R_{61})]) \\ &= [(T_B - T_A)/\ln(3/7)], \end{aligned}$$

where $(T_B-T_A)=19$ us. for a nickel, $(T_B-T_A)=70$ us. for a dime, and $(T_B-T_A)=180$ us. for a quarter. Based upon such determinations the $tau_c$ values for such coins, when such particular FIG. 6 embodiment was utilized, were calculated as $tau_{nickel}=22.4$ us., $tau_{dime}=82.6$ us., and $tau_{quarter}=212$ us.

Figure 23:
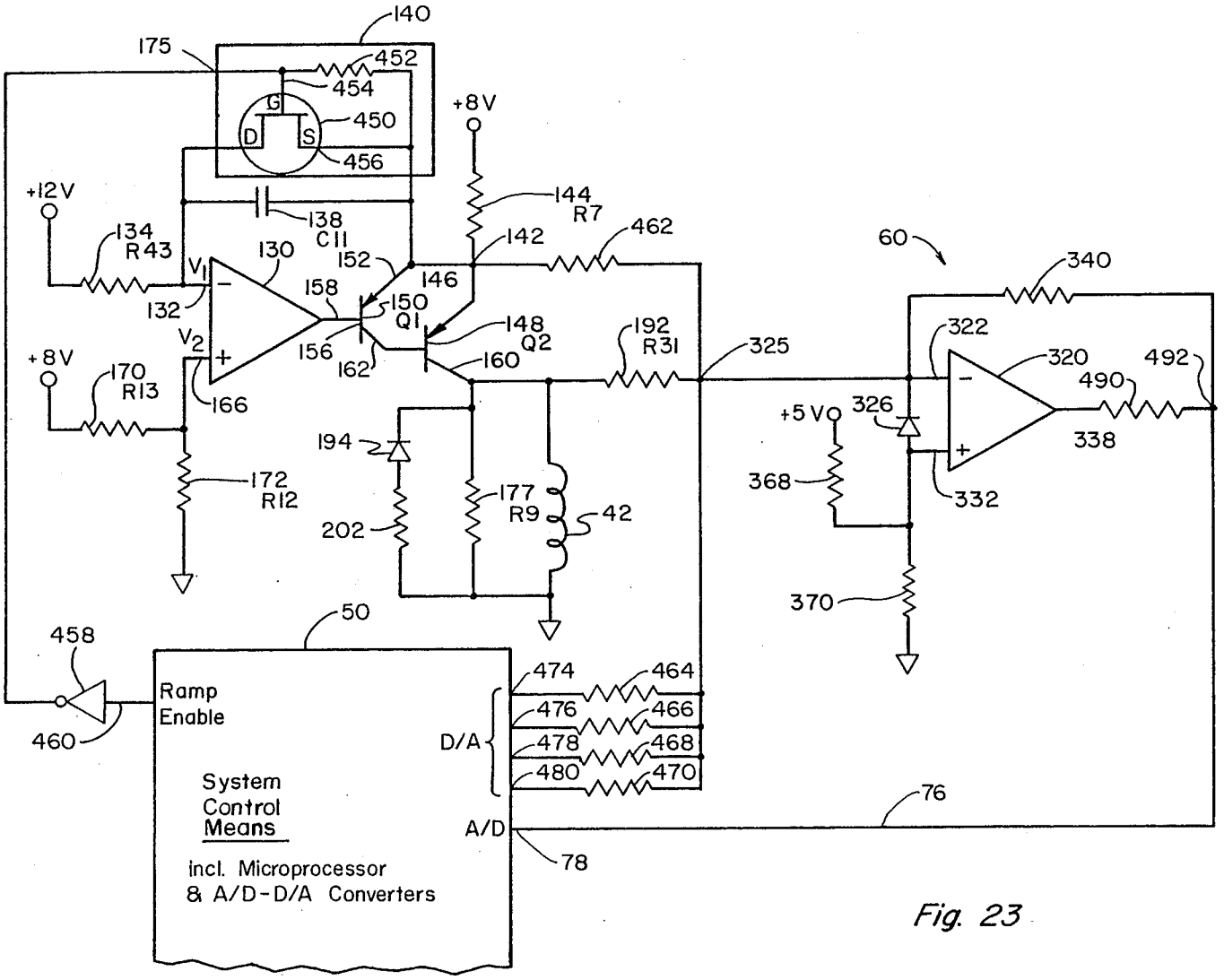
FIG. 23 is a schematic for an alternate preferred embodiment in which elimination of certain of the circuit components of the embodiment of FIG. 6 is effected due to the greater utilization of microprocessor capabilities.

Those knowledgeable in the art will recognize that the same or similar results could be obtained from other embodiments, including embodiments that make greater use of digital techniques and microprocessor programming than does the embodiment of FIG. 6. FIG. 23 depicts one such embodiment that includes many circuit portions which are the same as or similar to those depicted in FIG. 6. The FIG. 23 embodiment includes a current ramp generator 48, many components of which are essentially identical to components employed in the current ramp generator 48 depicted in FIG. 6. In the FIG. 23 embodiment, however, switch means 140 is depicted as being an FET 450 with a resistor 452 connected between its gate (G) input 454 and its source (S) connection 456. The gate (G) input 454 is also connected to control input 175 of switch means 140, which control input is connected to receive the output of an inverter 458 whose input 469 is connected to system control means 50 to receive ramp enable signals produced thereby. Resistor 452 is selected to have a value that is large compared to the value of resistor 144 ($R_7$) so that it will have a negligible effect with respect to the operation of the current ramp generator 48, as previously described with regard to FIGS. 6 and 7, yet will ensure that the FET 450 properly and effectively turns off.

Figure 24:
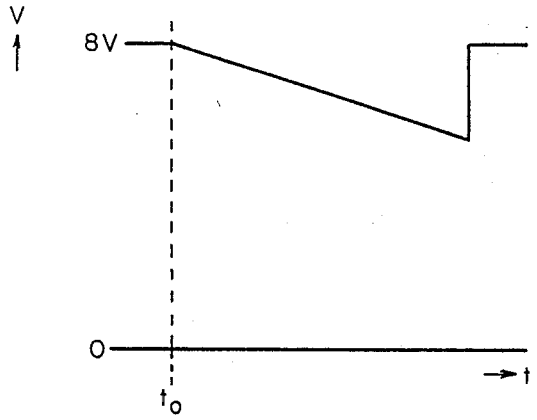
FIGS. 24–26 depict certain circuit waveforms at various points in the embodiment of FIG. 23.
Figure 25:
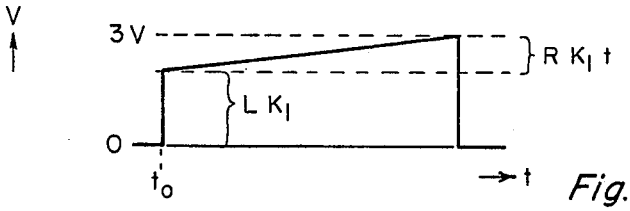

With the FIG. 23 embodiment, reference signal generation is effected both through the employment of a resistor 462 connected between node 142 and summing node 325 and through the employment of other resistors 464–470 all connected in parallel with one another between summing node 325 and respective D/A outputs 474–480 of system control means 50. Resistor 462 is selected to have such a value that the effect thereof with respect to the operation of the current ramp generator 48, as previously described with regard to FIGS. 6 and 7 will be negligible, but to permit the negative going ramp produced at node 142 during a coin detection operation cycle, as shown in FIG. 24, to be provided to summing node 325 along with the signals present on outputs 474–480 of system control means 50 and the value of $V_S(t)$ present across sensor coil 42, the $V_S(nc)$ waveform of which is shown in FIG. 25.

Figure 26:
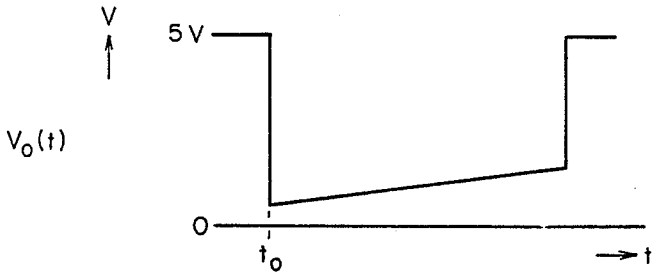

It may be readily observed that the particular components employed in the differential amplifier means 60 of the FIG. 23 embodiment are quite similar to those components employed in the differential amplifier means 60 of the FIG. 6 embodiment, except for the deletion of the switch means 344 and 348 and the resistors 342 and 348 associated therewith and the addition of a resistor 490 connected to the output 338 of differential amplifier 320, which resistor is connected within the feedback loop of such differential amplifier 320. As will be apparent to those skilled in the art, the purpose of such resistor 490 is to limit the output current and thereby prevent damage to the A/D converter circuitry within system control means 50. In light of previous discussions, it will readily understood that the $V_o(t)$ signal present at node 492 at any point in time during a coin detection operation cycle depends, in large part, upon the value of $V_S(t)$ at such time. For purposes of reference and comparison, FIG. 26 depicts a typical $V_o(t)$ waveform that is realized when no coin is present within the field of sensor coil 42. If a coin were present in such field during the application of a current ramp to the coil 42, the resulting waveform would include a decaying exponential factor, as has been previously discussed, the time constant of which is characteristic of such coin.

From the foregoing discussions, and especially the discussions regarding the operation of the FIG. 6 embodiment, those skilled in the art will recognize that a microprocessor may be included in system control means 50 and may be so programmed to obtain from the $V_o(t)$ signal provided to the analog-to-digital (A/D) input 78 of system control means 50 a plurality of time-voltage pairs corresponding to the values of $V_o(t)$ at specified points in time, to then utilize such time-voltage pairs to derive a $tau_c$ value for such particular coin, and to thereafter compare such derived $tau_c$ value against selected stored tau values indicative of acceptable coins and/or denomination values of acceptable coins to determine the acceptability and/or denomination value of such particular coin. The particular programming steps or techniques that would be employed in any particular instance will depend upon the particular system control means 50 utilized.

At this stage in the discussion of the present invention it should now be apparent that there have been described and discussed hereinabove several embodiments of coin detection means that can be employed to detect coins of both low and high magnetic permeability and which fulfill the various objects sought therefor and achieve the advantages sought, especially the advantage that only a single sensor coil need be employed, which advantage is made possible due to the relative independence from the coin-to-coil distance of the derived coin characteristic $tau_c$ for a coin detected within the field of the sensor coil. Those skilled in the art will recognize that the present invention is not restricted to utilization of only a single sensor coil, however, and will understand that in various instances and constructions the use of multiple sensor coils may be desirable or advantageous. They will also recognize that, although the embodiments discussed hereinbefore have employed current ramp generators that operate under control of the system control means, it is possible to employ current ramp generators that operate asynchronously with respect to the system control means, so long as the system is otherwise so designed, constructed, and/or programmed to permit the development by such system of data corresponding to a plurality of time-voltage pairs for use in deriving $tau_c$ values for coins within the field of the sensor coil. All such variations on and modifications of the disclosed embodiments are considered to fall within the spirit and scope of the present invention.

From all the foregoing, it should be abundantly clear that the $tau_c$ value that is derived by the present invention for any coin within the field of the sensor coil is essentially independent of the distance between such coin and such coil, so long as such coin remains within the field, i.e., so long as there is total overlap between such coin and the field of the coil, and that such independence is important with regard to the present invention and an understanding thereof. It should be clearly understood, however, that such independence does not apply if the coin is not totally within the field of the coil, i.e., if there is not total overlap between the coin and the field of the coil. In such event, the derived $tau_c$ value is clearly dependent upon coin position relative to the sensor coil.

Figure 27:
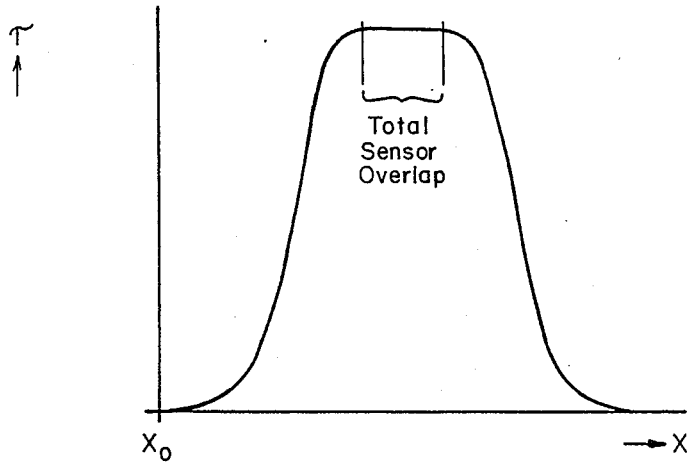
FIG. 27 illustrates the manner in which the derived value of $tau_c$ for a given deposited coin would be expected to vary with position as such coin moves past a sensor coil having a single sensor station and through the field thereof.

When a coin is deposited it moves along a coin path that carries it into and through the field of the coil, but it is totally within the field of the coil for only a relatively short period of time. As the coin follows such coin path $tau_c$ values can be continuously iteratively derived by coin detection means constructed according to the present invention, but such derived $tau_c$ values will vary depending upon the extent to which the coin has entered into the field of the sensor coil, as is graphically illustrated by FIG. 27, which figure depicts typical $tau_c$ values derived as a given coin moves into and through the field of a typical pot core sensor coil such as might be employed in the present invention. Such figure vividly illustrates that, although $tau_c$ is essentially independent of coin-to-coil distance for any given coin while such coin is positioned within the field of the sensor coil, $tau_c$ is not independent of coin position when the coin is not totally within the field of such sensor coil but is passing into and through such field. As will be discussed in more detail hereinafter, such dependence of $tau_c$ upon coin position as the coin passes by the sensor coil, as opposed to the independence of $tau_c$ from coin-to-coil distance while the coin is totally within the field of the sensor coil, permits $tau_c$ values derived by the present invention to also be utilized with certain embodiments of the present invention for coin sizing purposes. In light of FIG. 27, it will be readily understood by those skilled in the art that the maximum derived $tau_c$ value for a given coin, which $tau_c$ value is obtained from an application of a current ramp to the sensor coil at a time when such coin is totally within the field of the sensor coil, is the value of $tau_c$ that is generally utilized, as described hereinbefore, to determine the acceptability and/or denomination of such coin.

As has previously been noted, although the present invention eliminates the need for multiple sensor coils due to the independence of $tau_c$ from coin-to-coil distance when a coin is within the field of the sensor coil, it does not restrict embodiments thereof to the use of a single sensor, nor does it require the sensor coil to be of any particular configuration. In practice, it has been found desirable to employ a "U" shaped core with windings upon the legs thereof connected in series with one another to form a single inductor, as depicted in FIG. 28, since such a sensor coil configuration permits derived tau values to be used not only in the manner set forth in detail hereinbefore to determine coin acceptability and/or denomination but also for coin sizing checks, as will become evident from that which follows.

Figure 28:
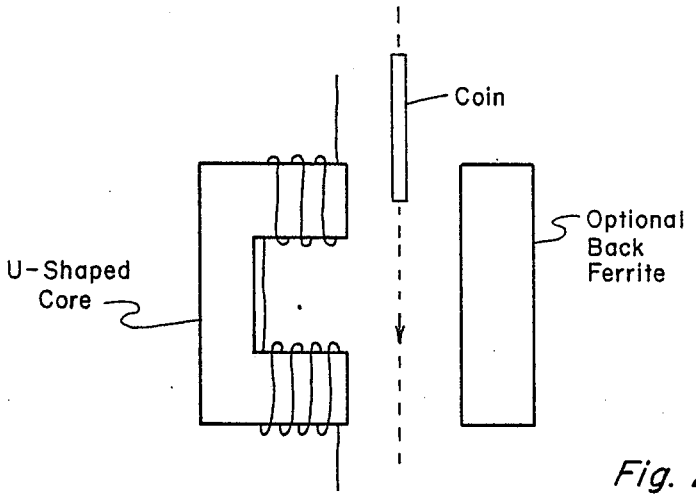
FIG. 28 depicts a sensor coil embodiment of a type that has two sensor stations and which may be used in the present invention.
Figure 29:
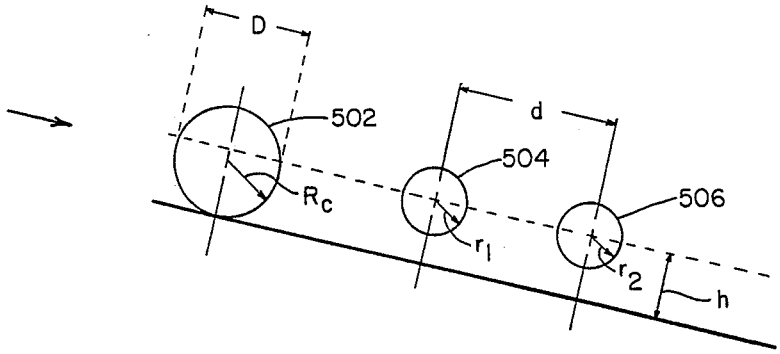
FIG. 29 is an illustration depicting a typical positioning of the sensor stations of the sensor coil embodiment of FIG. 27 relative to coin movements therepast along a coin rail.

With the sensor coil configuration depicted in FIG. 28 a deposited coin is caused to effectively pass by two sensor stations as it follows its coin path, as pictorially illustrated in FIG. 29. If $tau_c$ values are continuously iteratively derived during the time that such coin is passing the two sensor stations, the system control means 50 can utilize such derived $tau_c$ values to derive a coin sizing value $S_c$ characteristic of such particular coin, which value can be compared against pre-established stored coin size characteristic values to determine coin acceptability and/or denomination based upon coin sizing.

The use of various electrical or electronic means for determining or measuring coin dimensions, and the effect of various factors, such as coin speed and the height of sensors relative to true coin diameters, with regard to such determinations and measurements, have been previously described and discussed in various U.S. Patents, including U.S. Pat. Nos. 3,653,481; 3,739,895; 3,797,307; 3,797,628; 4,509,633; and 4,646,904. In view of the teachings therein, and for ease of discussion in providing a basic understanding of the manner in which derived $tau_c$ values can be utilized in coin sizing determination checks, it will here be assumed that deposited coins move past the sensor stations at constant speed, that the sensor stations are so positioned that the true diameters of all coins as they pass thereby are centered with respect to the sensor stations, and that the coins and sensors may be considered to have square faces when discussing overlap thereof. It will be readily recognized by those skilled in the art that, although such conditions do not apply in practice, they permit simplified discussion of the pertinent basic concepts.

In light of what has already been said, it will be recognized that the $tau_c$ values derived for a given coin 502 as it moves past the two sensor stations $S_1$ and $S_2$, denoted by the numbers 504 and 506 in FIG. 29, can be plotted as a function of coin position. By way of example, if the sensor stations $S_1$ and $S_2$ are positioned a distance d apart (as measured center to center) and are considered to have effective respective radii of $r_1$ and $r_2$, the expected waveform for $tau_c$ (x) for a coin whose diameter $D_c=2R_c$, where $R_c$ is the radius of such coin, and where the coin diameter is such that no simultaneous overlap of both sensors $S_1$ and $S_2$ occurs, i.e., $D_c=2R_c<d-r_1-r_2$, would be expected to be similar to that waveform depicted in FIG. 30, where $j_1$ is some fraction of $P_1$ (peak 1) and $j_2$ is some fraction of $P_2$ (peak 2), and where, for the sake of simplicity, $j_1=j_2$. Those skilled in the art will understand that a coin sizing characteristic $S_c$ can be selected based upon such characteristic being some function of $X_1$, $X_2$, $X_3$, and $X_4$, i.e., $S_c=f(X_1, X_2, X_3, X_4)$, and a characteristic value can be derived for each deposited coin as it passes by the sensor stations $S_1$ and $S_2$.

For example, the characteristic could be selected to be $S_{c1}=(X_4-X_1)/(X_3-X_2)$. If $X_1$ and $X_2$ are positions at which the sensor station $S_1$ is half-covered by the coin as it moves past such sensor station and $X_3$ and $X_4$ are positions at which the sensor station $S_2$ is half-covered by the coin as it moves past such sensor station, the values of $X_1$, $X_2$, $X_3$, and $X_4$ relative to some arbitrary $X_o$ position would be $X_1=X_k+r_1$, $X_2=X_k+r_1+2R_c$, $X_3=X_k+r_1+d$, and $X_4=X_k+r_1+d+2R_c$, as a consequence of which $S_{c1}$ would be $S_{c1}=(d+2R_c)/(d-2R_c)$. It will be readily apparent that, if $S_{c1}$ is selected as the characteristic, the larger the radius of the deposited coin, the larger will be the derived value $S_{c1}$. Alternatively, the characteristic could be selected to be $S_{c2}=[(X_2-X_1)+(X_4-X_3)]/[(X_3-X_1)+(X_4-X_2)]$ or some other function of $X_1$, $X_2$, $X_3$, and $X_4$. With the position values for $X_1$, $X_2$, $X_3$, and $X_4$ as set forth previously, $S_{c2}=2R_c/d$. Those skilled in the art will recognize that, although the characteristic $S_{c2}$ is proportional to $R_c$ and $S_{c1}$ is not, either or both could be advantageously utilized as coin sizing characteristics since they both exhibit a one-to-one correspondence between each derived characteristic value thereof and the radius of the particular coin with which such derived characteristic value is associated.

Figure 31:
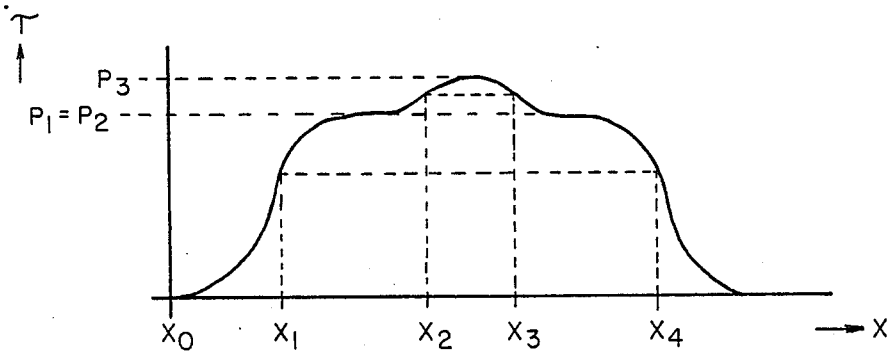

It should be noted that, if the relationship between the coin radius $R_c$, the distance d, and the radii $r_1$ and $r_2$ are different than specified hereinabove, the waveform for $tau_c(x)$ may have a different appearance from that depicted in FIG. 29. For example, if the coin diameter is greater than the distance between the sensor stations, i.e., $D_c=2R_c>d$, the expected waveform would be as depicted in FIG. 31. It will be recognized, however, that coin size characteristics can be derived in much the same fashion for such a waveform as was true with regard to the waveform depicted in FIG. 29.

Figure 30:
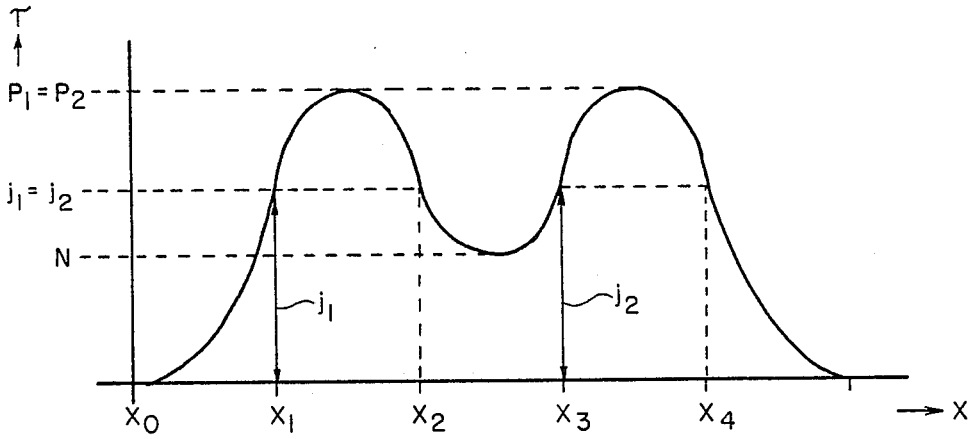
FIGS. 30–31 illustrate the manner in which, under certain conditions, the derived value of $tau_c$ for a given deposited coin would be expected to vary with coin position as such coin moves past the sensor stations of the sensor coil embodiment of FIG. 27 and through the field thereof.

In practice, it has been found that, if the distance d between the sensor stations is so selected that acceptable coins produce waveforms similar to those depicted in FIG. 30, which, for example, is the case if $d-r_1-r_2<2R_{c<d+r1}+r_2$, a coin sizing parameter $S_{c3}$ based upon peak values $P_1$ and $P_2$ and intermediate nadir value N can be advantageously employed. Since the derived value of $tau_c$ at $P_1$ can be considered to be the value that occurs when the overlap between sensor station $S_1$ and the deposited coin is greatest, since the derived value of $tau_c$ at $P_2$ can be considered to be the value that occurs when the overlap between sensor station $S_2$ and the deposited coin is greatest, and since the derived value of $tau_c$ at N can be considered to be the value that occurs when the deposited coin is positioned centrally intermediately with respect to sensor stations $S_1$ and $S_2$, sizing parameter $S_{c3}$ can be chosen to be a function of $P_1$, $P_2$, and N, i.e., $S_{c3}=f(P_1, P_2, N)$, where the values of $P_1$, $P_2$, and N are determined by the overlap of the deposited coin with sensor stations $S_1$ and $S_2$. Those skilled in the art will appreciate that the area overlap for sensor $S_1$ at $P_1$ is a function of $2r_1$, that the area overlap of sensor $S_2$ at $P_2$ is a function of $2r_2$, and that the area overlap of sensors $S_1$ and $S_2$ at N is a function of $2R_c-(d-r_1-r_2)$, as a consequence of which $S_{c3}=f(P_1, P_2, N)=(P_1+P_2)/N$ can be considered to be approximately $S_{c3}=(2r_1+2r_2)/[2R_c-(d-r_1-r_2)]$, which, for $r_1=r_2$, becomes $S_{cs}=4r_1/(2R_c+2r_1-d)$. In view of the foregoing it will be understood that the ratio $(P_1+P_2)/N$ can therefore be utilized to derive a coin sizing factor $S_{c3}$ for a deposited coin, which coin sizing factor can be compared against stored coin sizing factors for acceptably sized coins to determine the coin size acceptability of the deposited coin.

Although the foregoing discussion with respect to the derivation of coin sizing characteristics has focused upon the use of derived $tau_c$ values as a deposited coin passes by two sensor stations, it will be readily understood that other derived or measured values, such as the amplitude of a particular signal as the coin passes by the sensor stations, could similarly be employed in the derivation of coin sizing characteristics. Those skilled in the art will recognize the value in and the advantages of utilizing a variety of parameters and coin validation and verification techniques to combat the increasingly sophisticated attempts to "cheat" coin-operated devices and systems and will readily understand and appreciate that many combinations of validation and verification techniques may be used in conjunction with one another to good effect.

In light of all the foregoing it should be evident that certain embodiments constructed according to the present invention can be utilized not only for coin detection and denomination discrimination based upon the independence of a particular $tau_c$ value derived for a coin within the field of the sensor coil from the distance between such coin and such coil, but also for coin size checking based upon the dependence upon coin position relative to such sensor coil of a series of $tau_c$ values derived for such coin as it passes into and through the field of such sensor coil. Such embodiments offer advantages even beyond those advantages listed hereinbefore and sought for the present invention, as a consequence of which such embodiments are considered to be of significant practical and economic benefit.

From all that has been said, it should now be clear that there has been shown and described a coin detection means and method, including various embodiments of such coin detection means, which fulfills the various objects and advantages sought therefor. It will be apparent to those skilled in the art, however, that many changes, modifications, variations, and other uses and applications of the subject coin detection means and method are possible and contemplated. All such changes, modifications, variations, and other uses and applications which do not depart from the spirit and scope of the invention are deemed to be covered by the invention, which is limited only by the claims which follow.

What is claimed is:

1. A coin detection means comprising a circuit means including a sensor coil means and a current ramp generator means connected to supply a current ramp to said sensor coil means for a limited duration of time, said sensor coil means having a field associated therewith, and detector means connected to said circuit means to monitor circuit performance characteristics thereof, such performance characteristics being affected by the presence of a coin within the field of said sensor coil means during the time that a current ramp is being supplied to said sensor coil means, said detector means responsive to changes in circuit performance characteristics when a coin is present within the field of said sensor coil means during the time that a current ramp is being supplied to said sensor coil means to produce output data, said output data produced being representative of the particular coin present within the field of said sensor coil means.

2. The coin detection means of claim 1 including system control means connected to receive said output data from said detector means, said system control means operable to derive from said output data a characteristic value representative of said particular coin present within the field of said sensor coil means.

3. The coin detection means of claim 2 wherein said derived characteristic value corresponds to a time constant the value of which is dependent upon the impedance of said particular coin present within the field of said sensor coil means.

4. The coin detection means of claim 2 wherein said current ramp generator means is operatively connected to said system control means and controllable thereby.

5. The coin detection means of claim 2 including reference signal generator means, said circuit means operable to produce a sensor output signal, said reference signal generator means operable to produce a reference signal corresponding to the sensor output signal produced in the absence of a coin within the field of said sensor coil means, said detector means operatively connected to receive said sensor output signal and said reference signal and including means responsive thereto to produce, during the time a current ramp is being supplied to said sensor coil means, a difference output signal the value of which at any point in time corresponds to the difference between the sensor output signal being produced and the reference signal.

6. The coin detection means of claim 5 wherein said output data includes said difference output signal.

7. The coin detection means of claim 6 wherein the values of said difference output signal produced during the time a current ramp is being supplied to said sensor coil means while a coin is present within the field of said sensor coil means define an exponential function.

8. The coin detection means of claim 7 wherein said system control means includes means for deriving from said difference output signal a characteristic value representative of the particular coin present within the field of said sensor coil means.

9. The coin detection means of claim 8 wherein said means for deriving a characteristic value includes a microprocessor.

10. The coin detection means of claim 9 wherein said microprocessor is programmed to utilize a plurality of discrete values of the difference output signal provided to the system control means to determine the time constant of said exponential function.

11. The coin detection means of claim 10 wherein said system control means includes memory means for storing a plurality of pre-established coin characteristic values and said microprocessor is operatively connected to said memory means to retrieve stored values therefrom, and wherein said microprocessor is further programmed to compare said determined time constant against one or more of said pre-established coin characteristic values to determine whether the particular coin present within the field of said sensor coil means is an acceptable coin.

12. The coin detection means of claim 6 wherein the value of said difference output signal when no coin is present within the field of said sensor coil means is defined to be a base reference value, wherein the values of said difference output signal produced during the time a current ramp is being supplied to said sensor coil means while a coin is present within the field of said sensor coil means define a decaying exponential function, and wherein said system control means includes means for detecting the value of said difference output signal relative to said base reference value during the time that a current ramp is being supplied to said sensor coil means, the detected values during such time being determinative of whether a coin is present in the field of said sensor coil means and, if so, whether such coin is a coin of high or low magnetic permeability.

13. The coin detection means of claim 12 wherein said means for detecting the value of said difference output signal relative to said base reference value during the time that a current ramp is being supplied to said sensor coil means includes a microprocessor.

14. The coin detection means of claim 13 wherein said microprocessor is operable under program control to derive from said difference output signal a characteristic value representative of the particular coin present within the field of said sensor coil means.

15. The coin detection means of claim 14 wherein said microprocessor is programmed to utilize a plurality of discrete values of the difference output signal provided to the system control means to determine the time constant of said decaying exponential function.

16. The coin detection means of claim 15 wherein said system control means includes memory means for storing a plurality of pre-established coin characteristic values and said microprocessor is operatively connected to said memory means to retrieve stored values therefrom, and wherein said microprocessor is further programmed to compare said determined time constant against one or more of said pre-established coin characteristic values to determine whether the particular coin present within the field of said sensor coil means is an acceptable coin.

17. The coin detection means of claim 16 wherein said microprocessor is also programmed to determine a denomination value for an acceptable coin upon the basis of the comparisons between said determined time constant and said pre-established coin characteristic values.

18. The coin detection means of claim 5 wherein said detector means includes data determination means operatively connected to receive said difference output signal, said data determination means operable during the time a current ramp is being supplied to said sensor coil means to determine a plurality of discrete time-value data pairs of said difference output signal and to produce time-value data, said output data including said time-value data.

19. The coin detection means of claim 18 wherein said data determination means includes sampling means operatively connected to receive said difference output signal and operable to sample said difference output signal at discrete times.

20. The coin detection means of claim 19 wherein said sampling means is operatively connected to said system control means to be controllable thereby.

21. The coin detection means of claim 18 wherein said data determination means includes a sample and hold means operatively connected to receive said difference output signal and including a hold output, said sample and hold means operable to sample said difference output signal at discrete times and to hold the sampled value on said hold output until the next sampling operation, said hold output connected to a means for establishing a target value the value of which is a function of said sampled value on said hold output, a comparator means operatively connected to said means for establishing a target value and to receive said difference output signal, said comparator means operable to produce a detection signal when the value of said difference output signal equals said target value, said time-value data including said detection signal.

22. The coin detection means of claim 21 wherein said sample and hold means is operable under control of said system control means and said system control means is operable to determine the time lapse between a sampling operation by said sample and hold means and the occurrence of said detection signal.

23. The coin detection means of claim 22 wherein the values of said difference output signal produced during the time a current ramp is being supplied to said sensor coil means while a coin is present within the field of said sensor coil means define a decaying exponential function.

24. The coin detection means of claim 2 wherein said system control means includes memory means for storing a plurality of pre-established coin characteristic values and a microprocessor operatively connected to said memory means to retrieve stored values therefrom, said microprocessor being programmed to compare said derived coin characteristic value against one or more of said pre-established coin characteristic values to determine whether the particular coin present within the field of said sensor coil means is an acceptable coin.

25. The coin detection means of claim 24 wherein said microprocessor is also programmed to determine a denomination value for an acceptable coin upon the basis of the comparisons between said derived coin characteristic value and said pre-established coin characteristic values.

26. The coin detection means of claim 1 wherein the circuit performance characteristics of said circuit means are affected to a varying extent depending upon the degree of overlap between a coin and the field of said sensor coil means, said current ramp generator means being operable as a coin enters, passes through, and exits the field of said sensor coil means to repetitively supply a current ramp to said sensor coil means at spaced time intervals, said sensor coil means including two spaced sensing coil portions each having a respective field associated therewith, said coin detection means including system control means connected to receive said output data from said detector means, said system control means operable to derive from the totality of output data produced in response to the repetitive applications of a current ramp to said sensor coil means a coin sizing value representative of the size of the particular coin passing through the field of said sensor coil means.

27. The coin detection means of claim 26 wherein said output data produced during the time a current ramp is being supplied to said sensor coil means and when there is at least partial overlap between a coin and the field of said sensor coil means defines an exponential function having a time constant the value of which is dependent upon the impedance of such coin and the extent of overlap between such coin and the field of said sensor coil means.

28. The coin detection means of claim 27 wherein said system control means is operable to determine said time constant values for each exponential signal produced and to derive from the totality of such determined time constant values said coin sizing value for such coin.

29. The coin detection means of claim 28 wherein said coin sizing value is a function of said determined time constant values.

30. The coin detection means of claim 28 wherein said system control means includes a microprocessor and memory means for storing a plurality of pre-established coin sizing values, said microprocessor operatively connected to said memory means to retrieve stored values therefrom and programmed to compare said derived coin sizing value against one or more of said pre-established coin sizing values to determine whether the particular coin passing through the field of said sensor coil means is of a size corresponding to that of an acceptable coin.

* * * * *

UNITED STATES PATENT AND TRADEMARK OFFICE

CERTIFICATE OF CORRECTION

PATENT NO. : 4,809,838

DATED : March 7, 1989

INVENTOR(S) : Rymond L. Houserman

It is certified that error appears in the above-indentified patent and that said Letters Patent is hereby corrected as shown below:

Column 3, line 39, after the word "is", delete the ",".

Column 4, line 62, the equation therein for $V_{s(cp)}$ should appear as follows:

--$V_{s(cp)} = k_1L_s+k_1R_st - k_2e^{(-t/tau_c)} + K_o(c)$--.

Column 5, line 16, "(waveform $V_{s(H)}$" should be --(waveform $V_{s(H)}$)--.

Column 5, line 39, the equation therein for $V_A$ should appear as follows:

--$V_A = k_2e^{(-T_A/tau_c)}$--.

Column 5, line 40, the equation therein for $V_B$ should appear as follows:

--$V_B = k_2e^{(-T_B/tau_c)}$--.

Column 5, lines 51-52, the equation therein for $V_B$ should appear as follows:

--$V_B = k_2e^{(-T_B/tau_c)}$--.

Column 5, lines 54-55, the equation therein for $V_A$ should appear as follows:

--$V_A = k_2e^{(-T_A/tau_c)} = k_3\, k_2e^{(-T_B/tau_c)}$--.

Column 5, lines 55-56, the equation therein for $e^{(-T_A/tau_c)}$ should appear, as follows:

--$e^{(-T_A/tau_c)} = k_3e^{(-T_B/tau_c)}$--.

Column 5, line 57, the equation therein for $\ln(k_3)$ should appear, as follows:

--$\ln(k_3) = [(T_B-T_A)/tau_c]$--.

UNITED STATES PATENT AND TRADEMARK OFFICE

CERTIFICATE OF CORRECTION

PATENT NO. : 4,809,838

DATED : March 7, 1989

INVENTOR(S) : Rymond L. Houserman

It is certified that error appears in the above-indentified patent and that said Letters Patent is hereby corrected as shown below:

Column 5, line 58, the equation therein for $tau_c$ should appear, as follows:

--$tau_c = [(T_B-T_A)/\ln(k_3)] = [(T_B-T_A)/\ln(V_A/V_B)]$--.

Column 6, lines 38-39, the equation therein for $V_D$ should appear, as follows:

--$V_D = k_2 e^{(-T_D/tau_c)} - K_o(c)$--.

Column 6, line 47, "are" should be --art--.

Column 7, line 24, "t-he" should be --the--.

Column 8, lines 39-40, the equation therein for $V_{S\&H}$ should appear, as follows:

--$V_{S\&H} = V_{diff}(T_A) = V_A$--.

Column 10, lines 42-43, the equation therein beginning "$8-V_3$" should appear, as follows:

--$8-V_3 = 8-V_2 = 8-[R_{12}/(R_{12}+R_{13})]8 = 8(1-[R_{12}/(R_{12}+R_{13})])$--.

Column 10, line 43, "." should be --,--.

Column 10, lines 48-49, the equation therein for $I_{out}$ should appear, as follows:

--$I_{out} = 8(1-[R_{12}/(R_{12}+R_{13})])/R_7 = 8[R_{13}/(R_{12}+R_{13})]/R_7$.--.

Column 10, line 64, the equation therein for $I_{R43}$ should appear, as follows:

--$I_{R43} = (12-V_1)/R_{43} = (12-[R_{12}/(R_{12}+R_{13})]8)/R_{43}$--.

UNITED STATES PATENT AND TRADEMARK OFFICE

CERTIFICATE OF CORRECTION

DATED : March 7, 1989

INVENTOR(S) : Raymond L. Houserman

It is certified that error appears in the above-indentified patent and that said Letters Patent is hereby corrected as shown below:

Column 10, lines 67-68, the equation therein for $I_{C11}$ should appear, as follows:

--$I_{C11} = C_{11}d(V_1-V_3)/dt = C_{11}d([R_{12}/(R_{12}+R_{13})]8-V_3)/dt$--.

Column 11, line 2, the equation therein beginning "$[R_{12}/$" should appear, as follows:

--$[R_{12}/(R_{12}+R_{13})]8-V_3 = 1/C_{11}\int^{t'} I_{C11}dt$, —.

Column 11, line 8, the equation therein for $V_3$ should appear, as follows:

--$V_3 = ([R_{12}/(R_{12}+R_{13})]8)-1/C_{11}\int^{t'} I_{C11}dt$ – –.

Column 11, line 11, the portion of the equation appearing therein should read, as follows:

--= $([R_{12}/(R_{12}+R_{13})]8)-1/C_{11}\int^{t'} I_{R43}dt$ – –.

Column 11, lines 14-16, the portion of the equation appearing therein should read, as follows:

--= $([R_{12}/(R_{12}+R_{13})]8)-1/C_{11}\int^{t'}[(12-[R_{12}/(R_{12}+R_{13})]8/R_{43}]dt$ – –.

Column 11, lines 24-25, the equation therein for $I_{R7}$ should appear, as follows:

--$I_{R7} = [8-([R_{12}/[R_{12}+R_{13}])8]-1/C_{11}[(12-[R_{12}/(R_{12}+R_{13})]8)/R_{43}]t)]/R_7$--.

Column 11, lines 29-30, the equation therein for $I_{R7}$ should appear, as follows:

--$I_{R7} = (8/R_7)(1-[R_{12}/(R_{12}+R_{13})])+(8t/R_7C_{11}R_{43})(1.5-[R_{12}/(R_{12}+R_{13})])$--.

Column 11, lines 34-35, the equation for $I_{out}$ should appear, as follows:

--$I_{out} = (8/R_7)(1-[R_{12}/(R_{12}+R_{13})])+(8t/R_7C_{11}R_{43})(1.5-[R_{12}/(R_{12}+R_{13})])$--.

UNITED STATES PATENT AND TRADEMARK OFFICE

CERTIFICATE OF CORRECTION

PATENT NO. : 4,809,838

DATED : March 7, 1989

INVENTOR(S) : Raymond L. Houserman

It is certified that error appears in the above-indentified patent and that said Letters Patent is hereby corrected as shown below:

Column 11, line 57, after "($D_2$)", insert --. -- to denote the end of a sentence and the beginning of a new sentence commencing "The anode".

Column 12, line 23, after "($C_{12}$), insert --. -- to denote the end of a sentence and the beginning of a new sentence commencing "It will".

Column 12, line 53, after "($D_6$)", insert --. -- to denote the end of a sentence and the beginning of a new sentence commencing "The anode".

Column 13, lines 50-55, the sentences appearing in lines 51-55 should not be indented and should appear in normal size type, with the sentence commencing at line 51 and beginning "The value of $V_6$" following the period in line 50 in normal fashion, such that lines 50-55 read, as follows:

--$V_{slope} = V_6-[(8-V_6)/[(R_4+R_5)C_{10}]]t$. The value of $V_6$ can be readily adjusted under control of system control means 50 in much the same way $V_{offset}$ is adjusted, based upon the signals provided at outputs 292 and 302 of system control means 50. Fig. 15 depicts a typical $V_{slope}$ waveform.--.

Column 14, lines 28-29, the equation therein for $R_{eff}$ should appear, as follows:

--$R_{eff} = 1/[(1/R_{29})+(1/R_{28})] = (R_{29}R_{28})/(R_{29}+R_{28})$--.

Column 14, lines 34-35, the equation therein for $V_o$ should appear, as follows:

--$V_o = V_{nulr}-[(V_s-Vnulr)/R_{31}+(V_{offset}-V_{nulr})/R_{33}+(V_{slope}-V_{nulr})/R_{30}]R_{eff}$--.

UNITED STATES PATENT AND TRADEMARK OFFICE

CERTIFICATE OF CORRECTION

PATENT NO. : 4,809,838

DATED : March 7, 1989

INVENTOR(S) : Raymond L. Houserman

It is certified that error appears in the above-indentified patent and that said Letters Patent is hereby corrected as shown below:

Column 16, lines 1-2, the equation therein for $V_o(t)$ should appear, as follows:

--$V_o(t) = V_{nulr}+k_2e^{(t/tau_c)}$--.

Column 16, lines 7-8, the equation therein for $V_k$ should appear, as follows:

--$V_k = V_{nulr}+(V_{nulr}+V_A-V_{nulr})[R_{61}/(R_{60}+R_{61})]$--.

Column 16, lines 8-9, the equation therein for $V_k$ should appear, as follows:

--$V_k = V_{nulr}+V_A[R_{61}/(R_{60}+R_{61})] = V_{nulr}+V_B$--.

Column 16, line 10, after "]" in the equation for $V_B$, insert --. -- to denote the end of a sentence and the beginning of a new sentence commencing with "So long".

Column 16, lines 30-31, the equation therein for $tau_c$ should appear, as follows:

--$tau_c = [(T_B-T_A)/\ln(V_A/V_B)] = ((T_B-T_A)/\ln[R_{60}+R_{61})/R_{61}])$--.

Column 16, line 66, delete the numeral "1".

Column 17, lines 30-31, the equation therein for $V_o(t)$ should appear, as follows:

--$V_o(t) = V_{nulr}+k_2e^{(-t/tau_c)}-K_o(c)$--.

Column 17, line 54, "Vo(H)" appearing at the beginning of such line should be --$V_{o(H)}$--.

Column 18, line 11, after "$V_{nulr}-K_o(c)$", insert --. -- to denote the end of a sentence and the beginning of a new sentence commencing with "It has been".

UNITED STATES PATENT AND TRADEMARK OFFICE

CERTIFICATE OF CORRECTION

PATENT NO. : 4,809,838 Page 6 of 6

DATED : March 7, 1989

INVENTOR(S) : Raymond L. Houserman

It is certified that error appears in the above-indentified patent and that said Letters Patent is hereby corrected as shown below:

Column 18, lines 50-51, the equation therein for $tau_c$ should appear, as follows:

--$tau_c = [(T_B-T_A)/\ln(V_A/V_B)] = ((T_B-T_A)/\ln[(R_{60}+R_{61})/R_{60}])$--.

Column 19, line 26, the equation therein for $V_B$ should appear, as follows:

--$V_B = V_A[R_{61}/(R_{60}+R_{61})] = (3/7)V_A$--.

Column 24, line 11, the equation appearing therein should read, as follows:

--$d-r_1-r_2 \langle 2R_c \langle d+r_1+r_2$--.

Signed and Sealed this

Twenty-ninth Day of November, 1994

*Attest:*

Bruce Lehman

BRUCE LEHMAN

*Attesting Officer*

*Commissioner of Patents and Trademarks*